United States Patent [19]

Jureit et al.

[11] 4,031,604

[45] June 28, 1977

[54] APPARATUS AND METHODS OF FABRICATING WOODEN FRAMES, PANELS AND THE LIKE

[75] Inventors: John Calvin Jureit, Coral Gables, Fla.; Howell J. Cotten, Keswick, Va.; Adolfo Castillo; Roy Leutwyler, both of Miami, Fla.

[73] Assignee: Automated Building Components, Inc., Miami, Fla.

[22] Filed: Dec. 12, 1975

[21] Appl. No.: 640,323

Related U.S. Application Data

[60] Continuation of Ser. No. 466,176, May 2, 1974, abandoned, which is a division of Ser. No. 328,605, Feb. 1, 1973, Pat. No. 3,848,791.

[52] U.S. Cl. ..... 29/429; 227/100; 227/152

[51] Int. Cl.² ..... B27F 7/00; B27F 7/02

[58] Field of Search ..... 29/430, 431, 429, 200 A, 29/200 P, 200 R; 144/318; 227/39, 40, 44, 99, 100, 101, 103, 150, 152, 153, 154

[56] References Cited

UNITED STATES PATENTS

| | | | |
|---|---|---|---|
| 3,086,210 | 4/1963 | Good et al. | 227/99 |
| 3,399,445 | 9/1968 | Carroll | 29/430 |
| 3,564,702 | 2/1971 | Hurn et al. | 29/430 |
| 3,601,882 | 8/1971 | McRae | 29/430 |
| 3,637,126 | 1/1972 | Heterick | 227/100 |
| 3,688,965 | 9/1972 | Kellner et al. | 227/100 |
| 3,734,376 | 5/1973 | Abernathy | 227/152 |
| 3,765,587 | 10/1973 | Davis | 227/100 |
| 3,822,815 | 7/1974 | Davis | 227/100 |

*Primary Examiner*—C.W. Lanham
*Assistant Examiner*—Daniel C. Crane
*Attorney, Agent, or Firm*—LeBlanc & Shur

[57] ABSTRACT

The apparatus includes a pair of spaced conveyors for conveying upper and lower frame plates through a pair of nailing assemblies. Each nailing assembly includes a nailing gun pivotal between upper and lower positions whereby nails can be driven through the plate and into a stud disposed between the plates at positions spaced along the width of the plate. The conveyor includes a drive unit for advancing the plates through the nailing assemblies discrete distances of 1.5, 16 or 24 inches. One of the conveyors and nailing assemblies is movable laterally relative to the other conveyor and nailing assembly whereby adjustments in width of the frame undergoing fabrication is accomplished. In use, a stud is butted against retractable stops upstanding between the nailing assemblies. Upon command, clamps carried by the nailing assemblies clamp the stud and frame plates one to the other and the nailing gun automatically drives a nail through the plate into the stud. If two nails are required, the gun automatically pivots to an elevated position to drive the next nail. Upon completion of nailing, the conveyor advances upon command a selected discrete distance whereupon an additional stud is located between the plates for nailing.

5 Claims, 26 Drawing Figures

FIG. 13
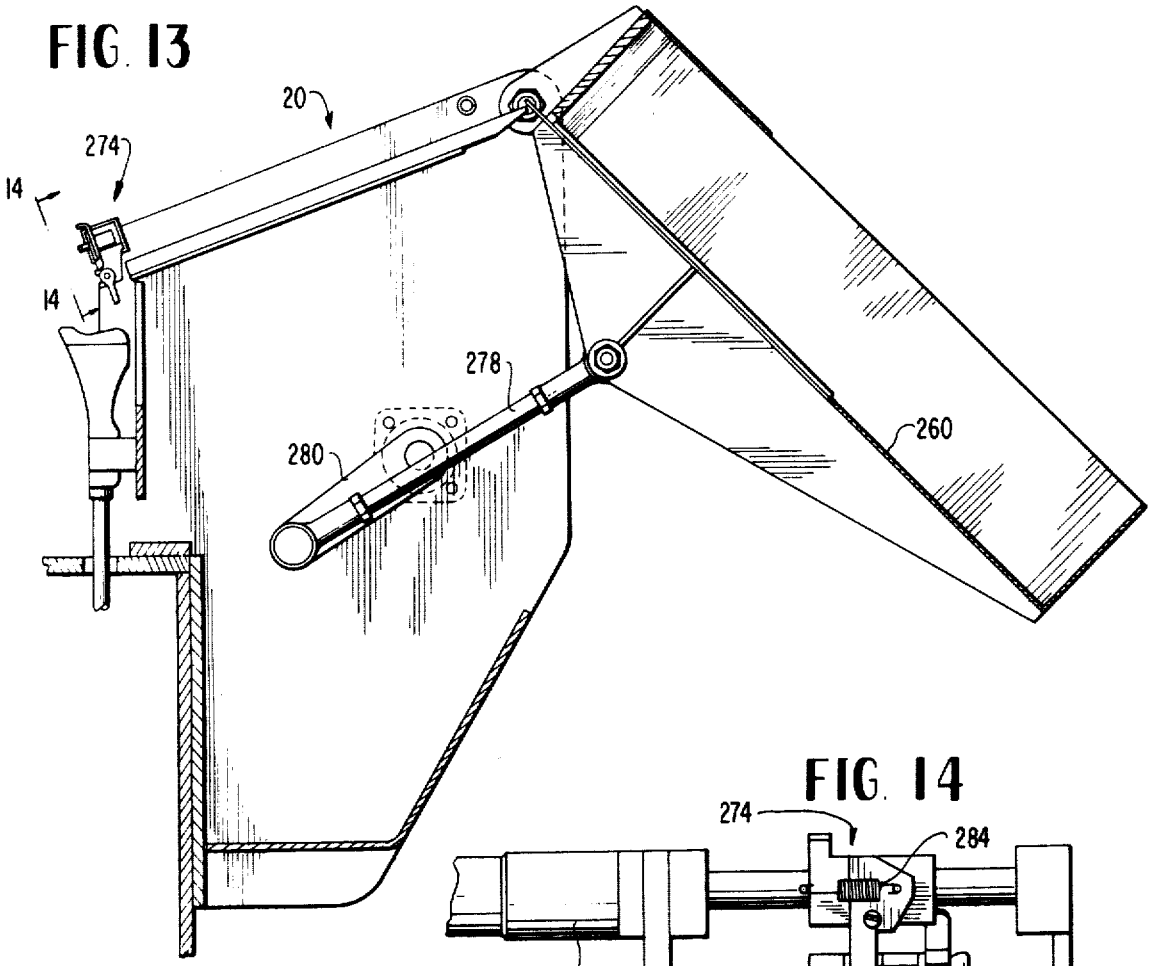
FIG. 14
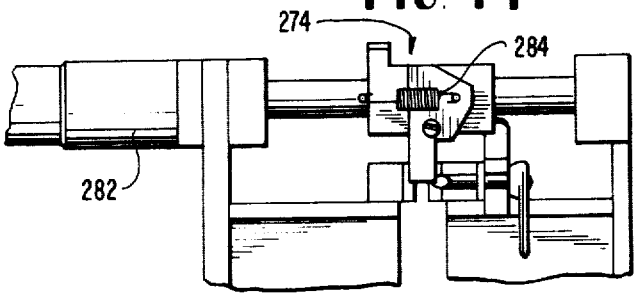
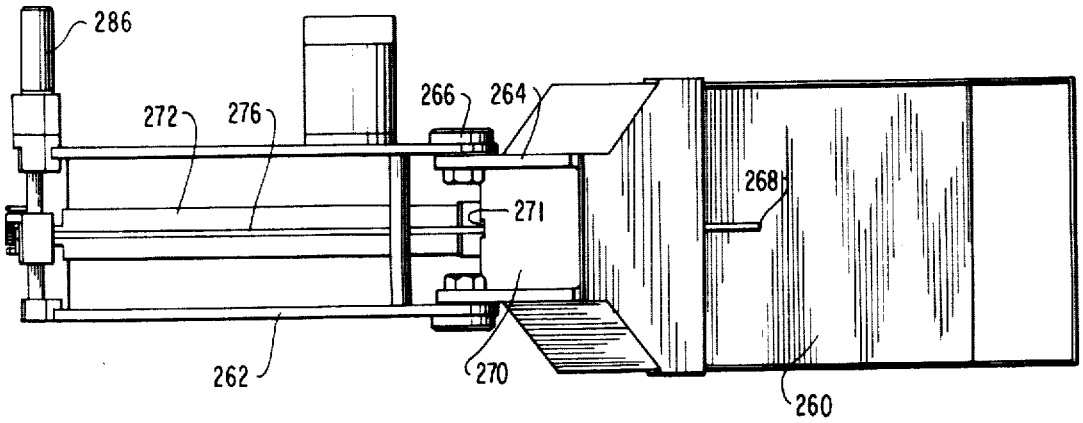
FIG. 15

APPARATUS AND METHODS OF FABRICATING WOODEN FRAMES, PANELS AND THE LIKE

This is a continuation of application Ser. No. 466,176 filed May 2, 1974, now abandoned, which in turn is a division of application Ser. No. 328,605 filed Feb. 1, 1973, now U.S. Pat. No. 3,848,791.

The present invention relates to apparatus and methods for fabricating wooden frames and particularly relates to apparatus and methods for nailing studs between the upper and lower plates of a wooden building frame.

There has been a long-felt need for an efficient and effective machine for fabricating wooden frames, panels and the like and particularly the interior and exterior wall frames in wooden building construction. Such frames usually include upper and lower plates with studs connecting between such plates and spaced on predetermined centers, usually 16 or 24 inch centers. Exterior or load-bearing frames of this type usually have a pair of lapped upper plates. The exterior and interior frames are of conventional height usually about 8 feet with the studs for the exterior frame about 1.5 inches shorter than the studs for the interior frames to account for the width of the lapped plate.

The present invention provides effective and efficient apparatus and methods for successively nailing studs between upper and lower wooden plates to form a completed building frame. To accomplish this, the present invention provides a pair of conveyors for locating the plates in lateral registration with nailing assemblies located on opposite sides of the conveyors. A drive unit for the conveyors includes apparatus for advancing the same selected discrete distances of 1.5, 16 and 24 inches whereby the partially completed frame is stepped through the nailing assemblies with the studs between the plates being successively aligned with the nailing guns carried by the nailing assemblies and nailed. The drive unit for the conveyor includes a rack and pinion. Dogs are selectively insertable in the path of movement of the rack whereby the conveyor longitudinally displaces the plates and studs of the partially completed frame in successive accurate longitudinal increments. The studs are thus nailed on the exact centers desired. The system prevents any inertia from moving the plates and studs beyond the positions aligned with the nailing guns. One of the conveyors and the corresponding nailing assembly on a like side of the apparatus are movable transversely as desired whereby frames of various heights can be fabricated. This width adjustment mechanism includes a discrete width adjusting means for moving the one conveyor and nailing assembly laterally a distance of 1.5 inches relative to the other conveyor and nailing assembly thereby providing for immediate set-up when switching from the fabrication of interior to exterior wall panels. The apparatus also includes a plurality of retractable stops located between the nailing assemblies and against which the studs are butted for alignment with the nailing guns.

Each nailing gun includes a carriage for pivoting the gun between selected elevations whereby either one or two nails can be driven through the plate into the stud. That is, frames can be formed utilizing 2×2's, 2×3's, 2×4's or 2×6's. The frames formed of 2×4's and 2×6's usually require two nails at each side of the frame to secure the plates and studs one to the other rather than the one nail required at each side when frames formed of 2×2's or 2×3's are utilized. Electrical-hydraulic control circuits are utilized for automatically sequencing the gun for driving one or two nails as selected. Nails for the guns are provided from a nail hopper which singulates nails randomly distributed from a nail hopper for successive insertion into the bore of the nail gun.

In operation, the plates are located in nailing position by manual operation of the conveyor. A stud is then butted against the stops extended between the nailing assemblies whereby the studs are aligned with the nailing guns with the plates at right angles thereto between the ends of the studs and the nailing guns. Upon command, clamps engage the stud ends and the respective plates to align the stud and plates in a common horizontal plane. After this clamping action is completed, the guns are automatically extended to butt the respective plates and to clamp them against respective opposite ends of the stud. A nail is then driven through each plate and into the corresponding end of the stud. If only one nail is required to secure each plate to the stud in a particular frame, the nailing guns automatically retract. If two nails are required to secure each plate to the stud, the control circuit causes each nailing gun to be elevated to drive a second nail through the plate into the stud. Upon completion of either the one or two nail nailing cycles, the clamps are automatically released. Also, upon completion of nailing, the stud stops are automatically retracted enabling the partially completed frame to be advanced a discrete selected distance by the conveyors to locate the plates in position for insertion of the next stud on its exact center in line with the nailing guns for the next nailing cycle.

Accordingly, it is a primary object of the present invention to provide a novel and improved apparatus and methods for fabricating wooden frames, panels and the like.

It is another object of the present invention to provide novel and improved apparatus and methods for fabricating wooden frames, panels and the like and particularly for nailing the upper and lower plates to studs in a building frame.

It is still another object of the present invention to provide novel and improved apparatus and methods for fabricating wooden frames and the like wherein the apparatus is readily and easily adapted for the fabrication of frames of different heights and frames utilizing a wide variety of differently sized framing members.

It is a further object of the present invention to provide novel and improved apparatus and methods for fabricating wooden frames, panels and the like wherein either one or two nails can be selected for securing each plate to the stud and wherein selection of two nails automatically sequences the machine for driving the two nails.

It is a still further object of the present invention to provide novel and improved apparatus and methods for fabricating wooden frames, panels and the like wherein the partially completed frame is advanced through the fabricating machine in selected incremental distances corresponding to the center to center spacing of the studs in the frame whereby additional studs are successively located on center and in nailing position between the plates.

These and further objects and advantages of the present invention will be more apparent upon reference to the following specification, claims, and appended drawings, wherein:

Figures 3, 5, 6:
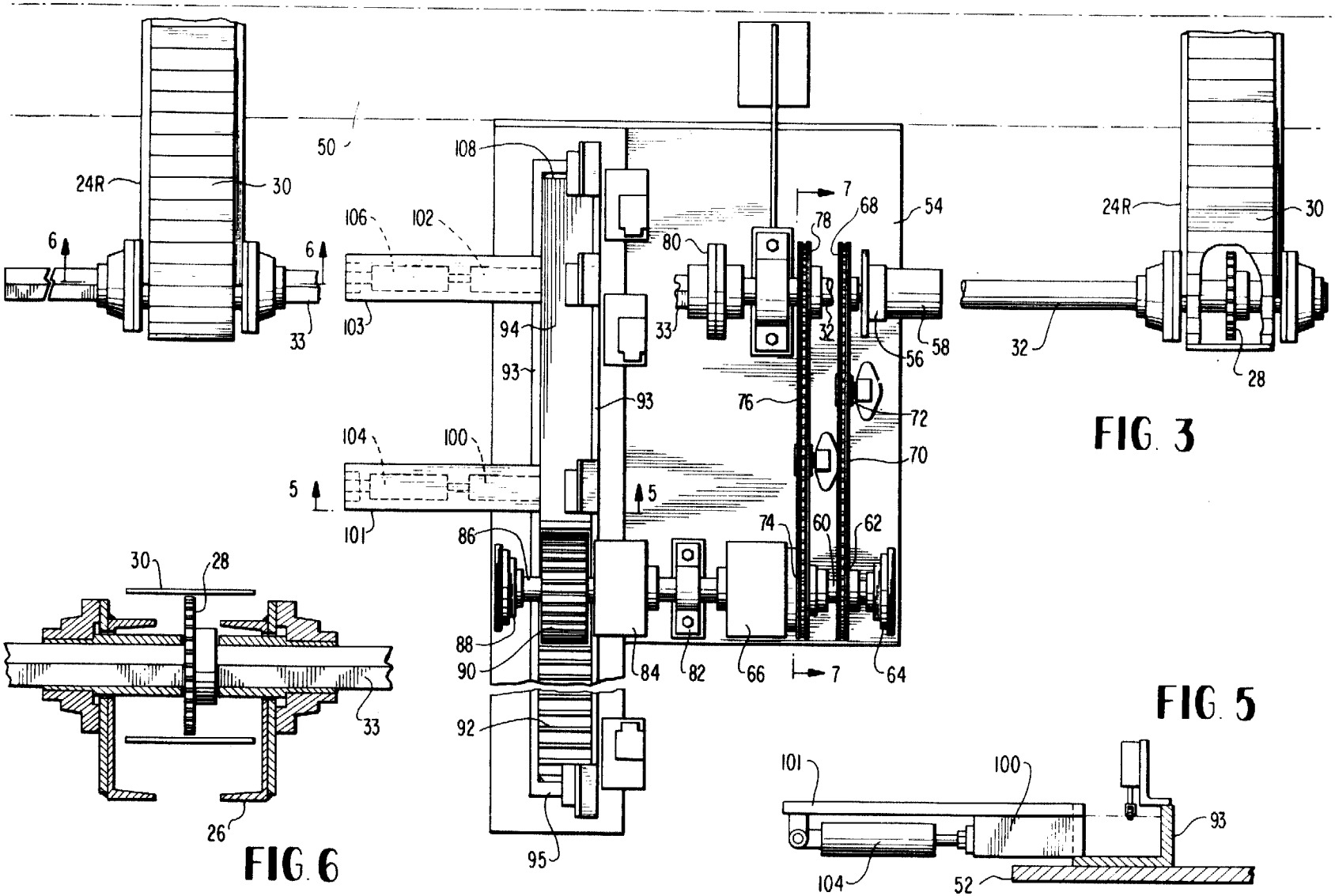
FIG. 3 is an enlarged fragmentary plan view of the machine of FIG. 1 and illustrating the drive unit for the conveyor thereof.
Figures 4, 7, 12:
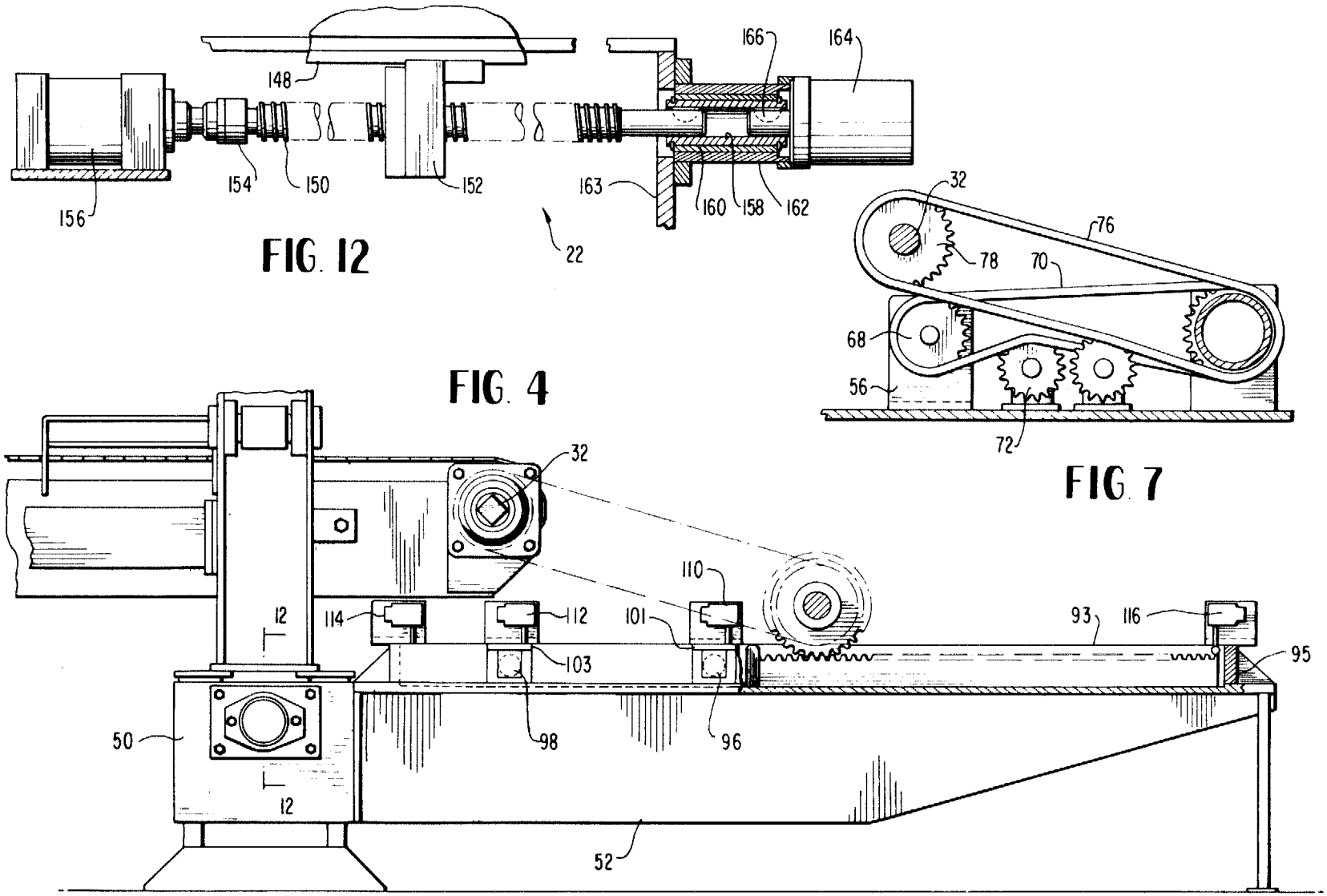
FIG. 4 is a fragmentary enlarged side elevational view of the drive unit assembly illustrated in FIG. 3.
Figures 8, 9:
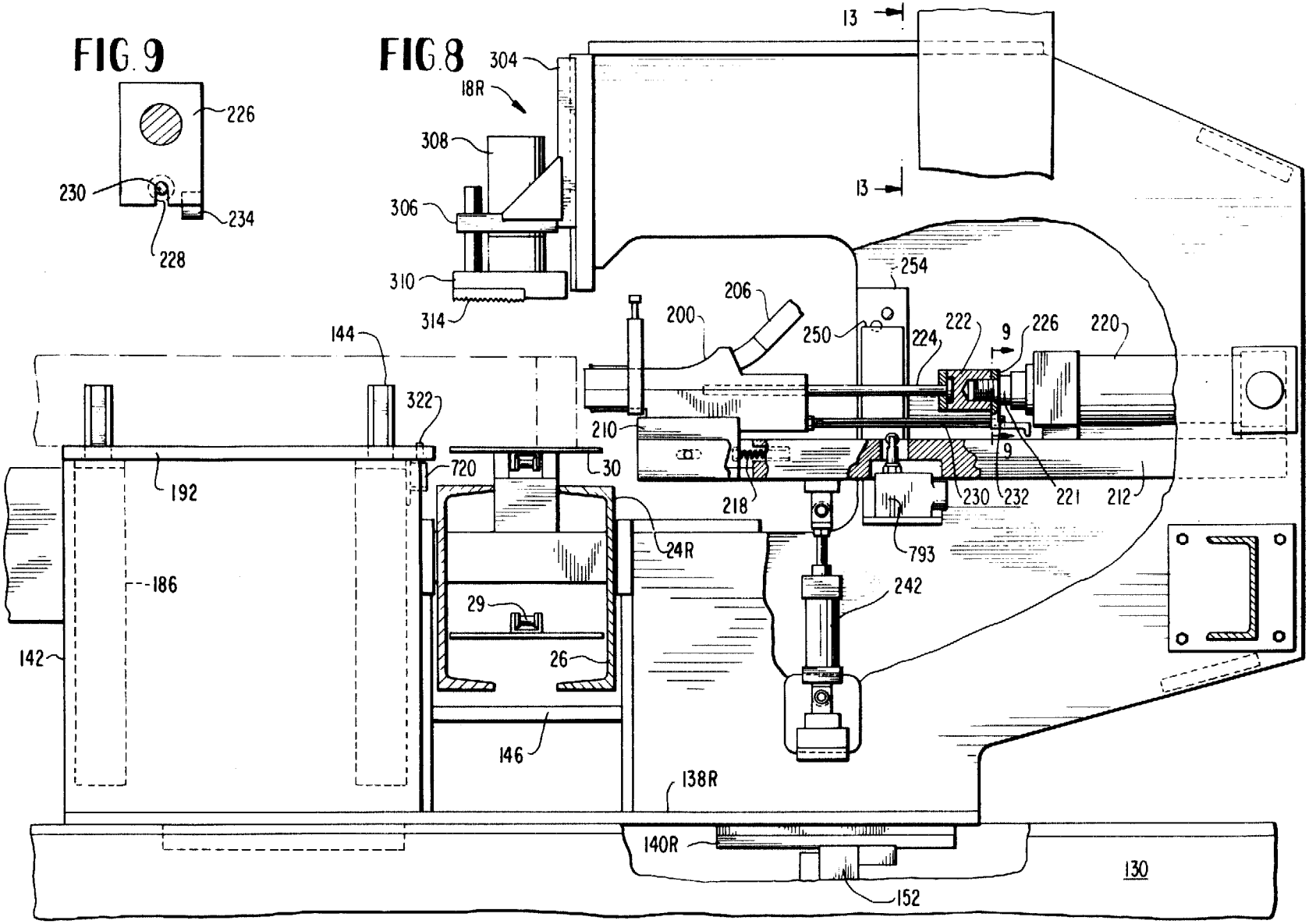
Figure 10:
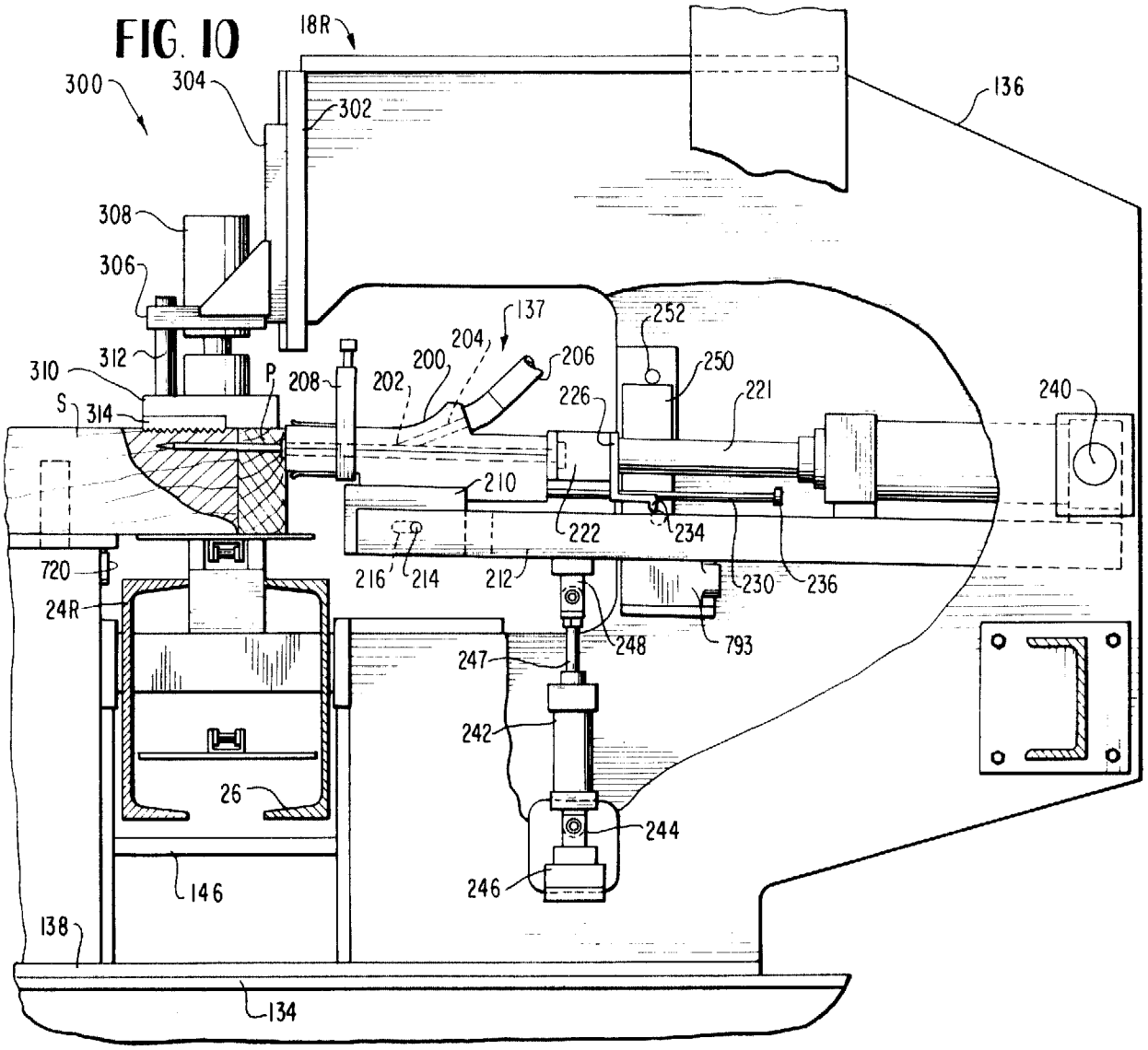
Figure 11:
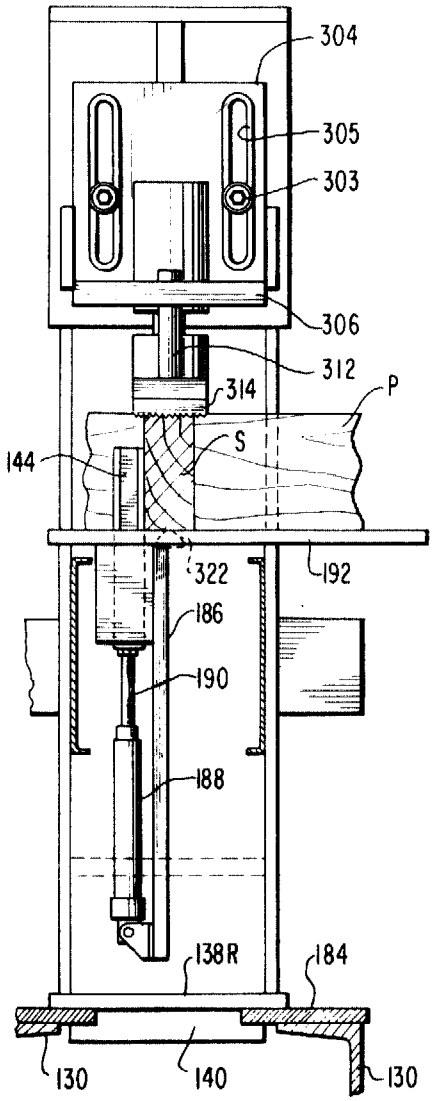
Figure 16:
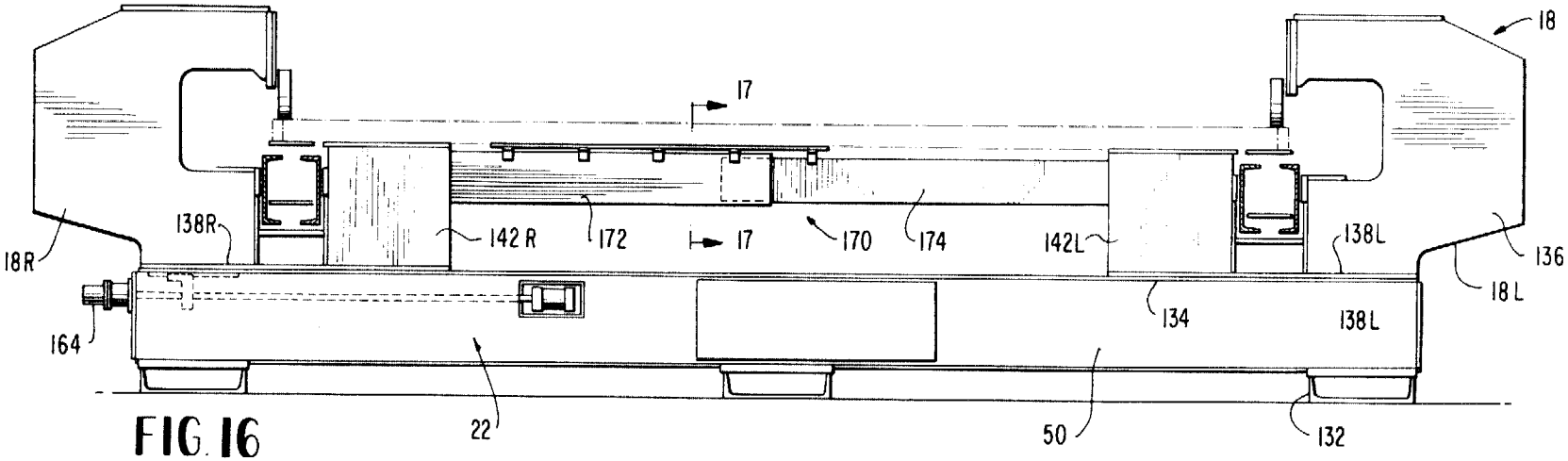
Figure 18:
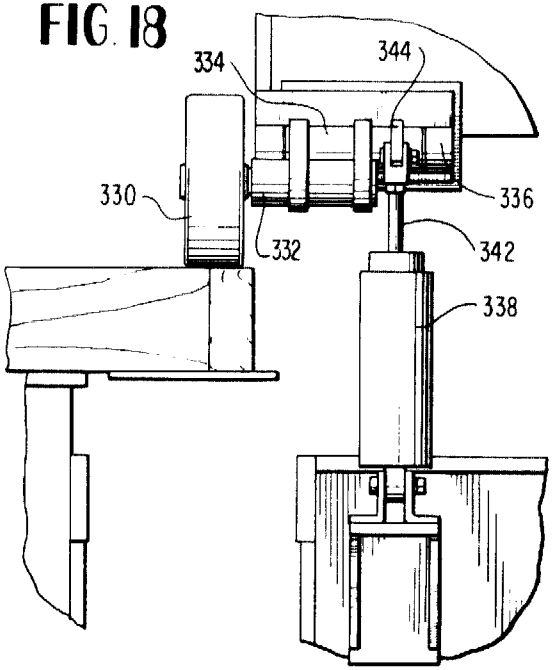
Figure 19:
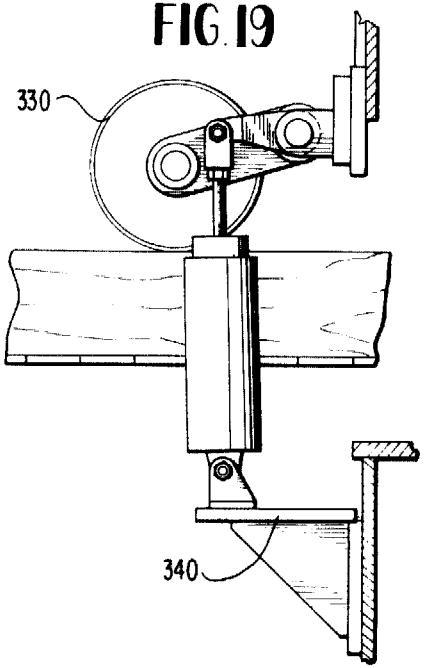
Figure 17:
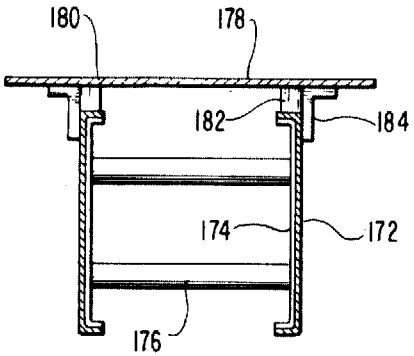
Figures 20A, 20B, 20C:
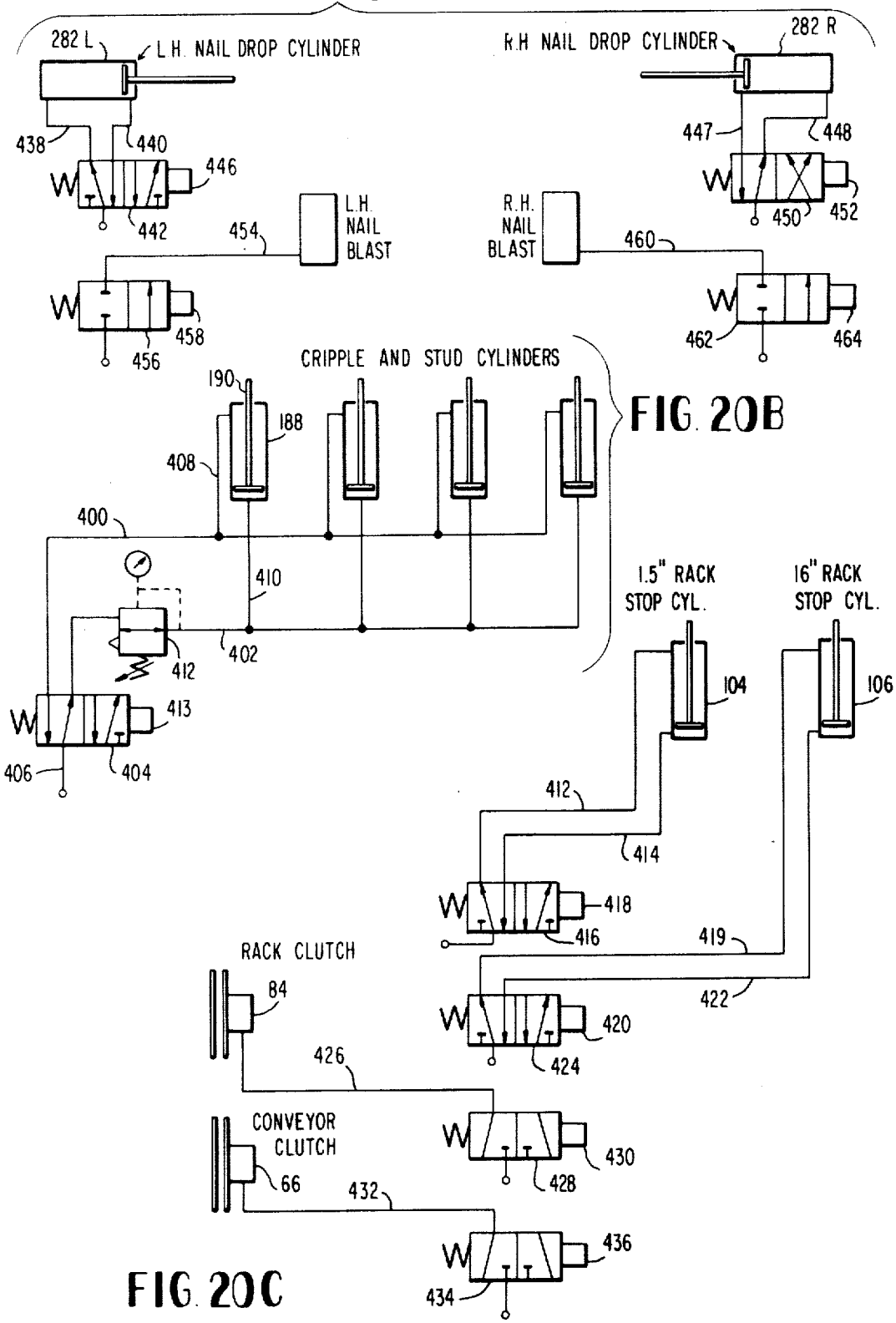
Figure 21:
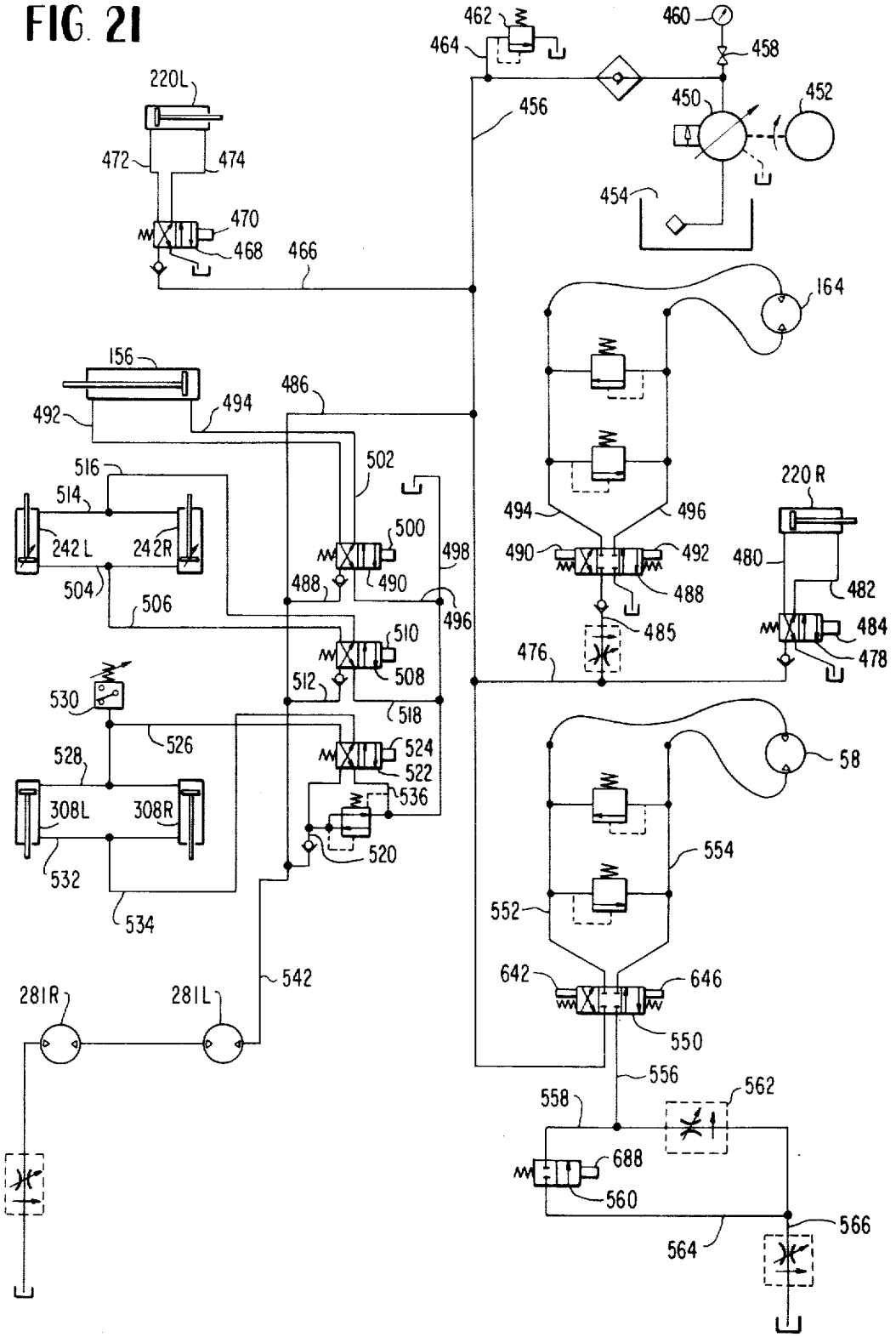
Figure 22A:
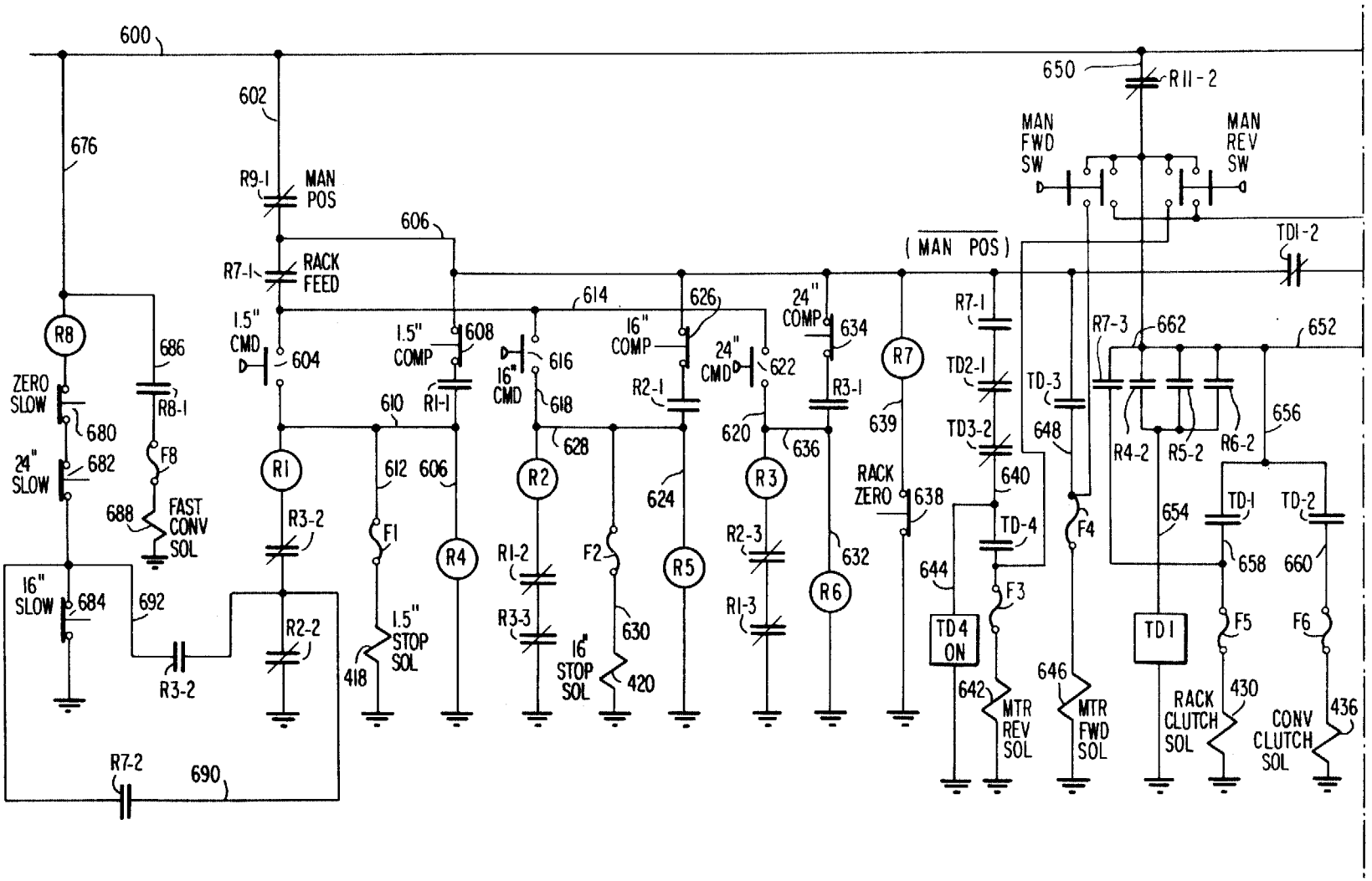
Figure 22B:
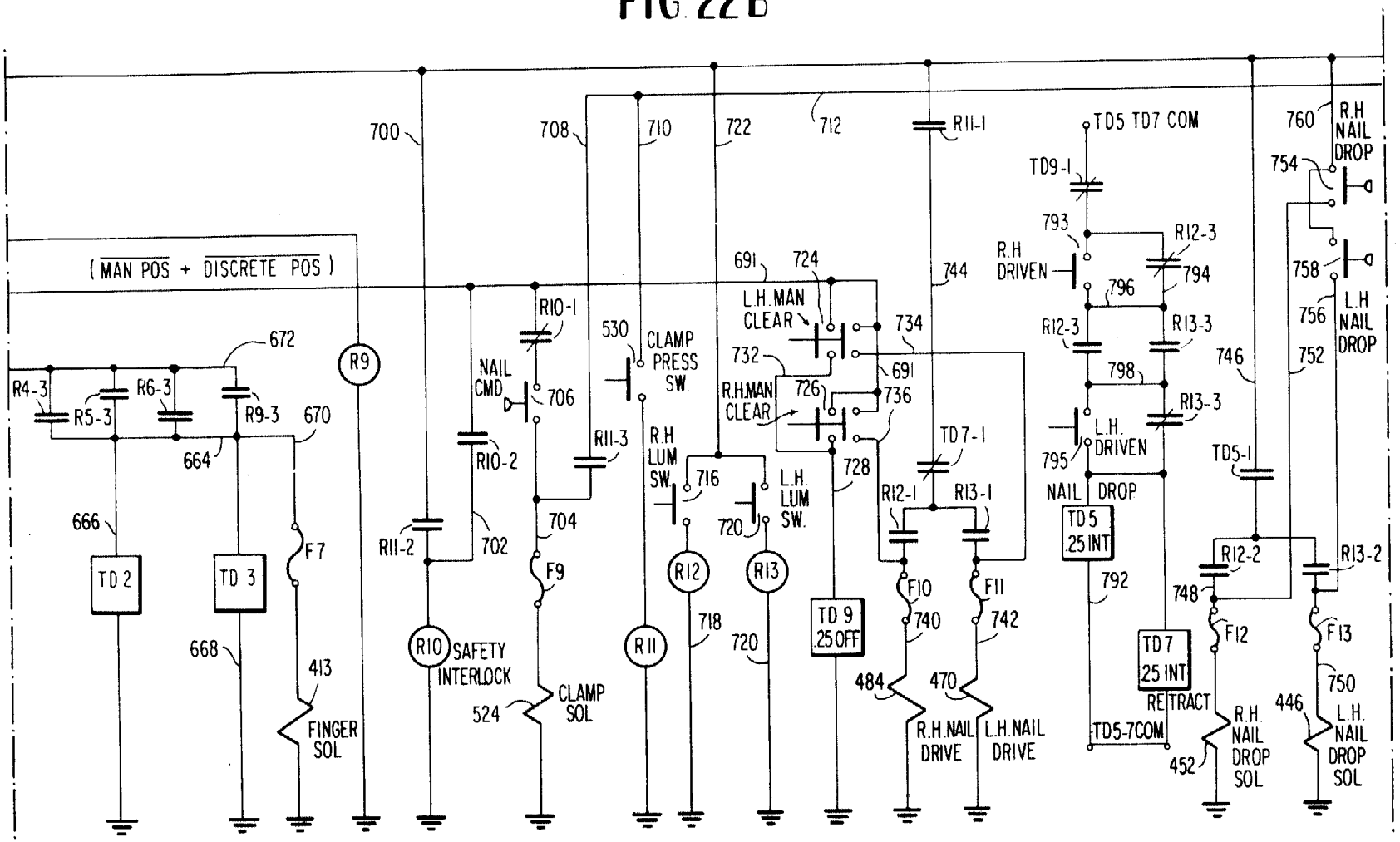
Figure 22C:
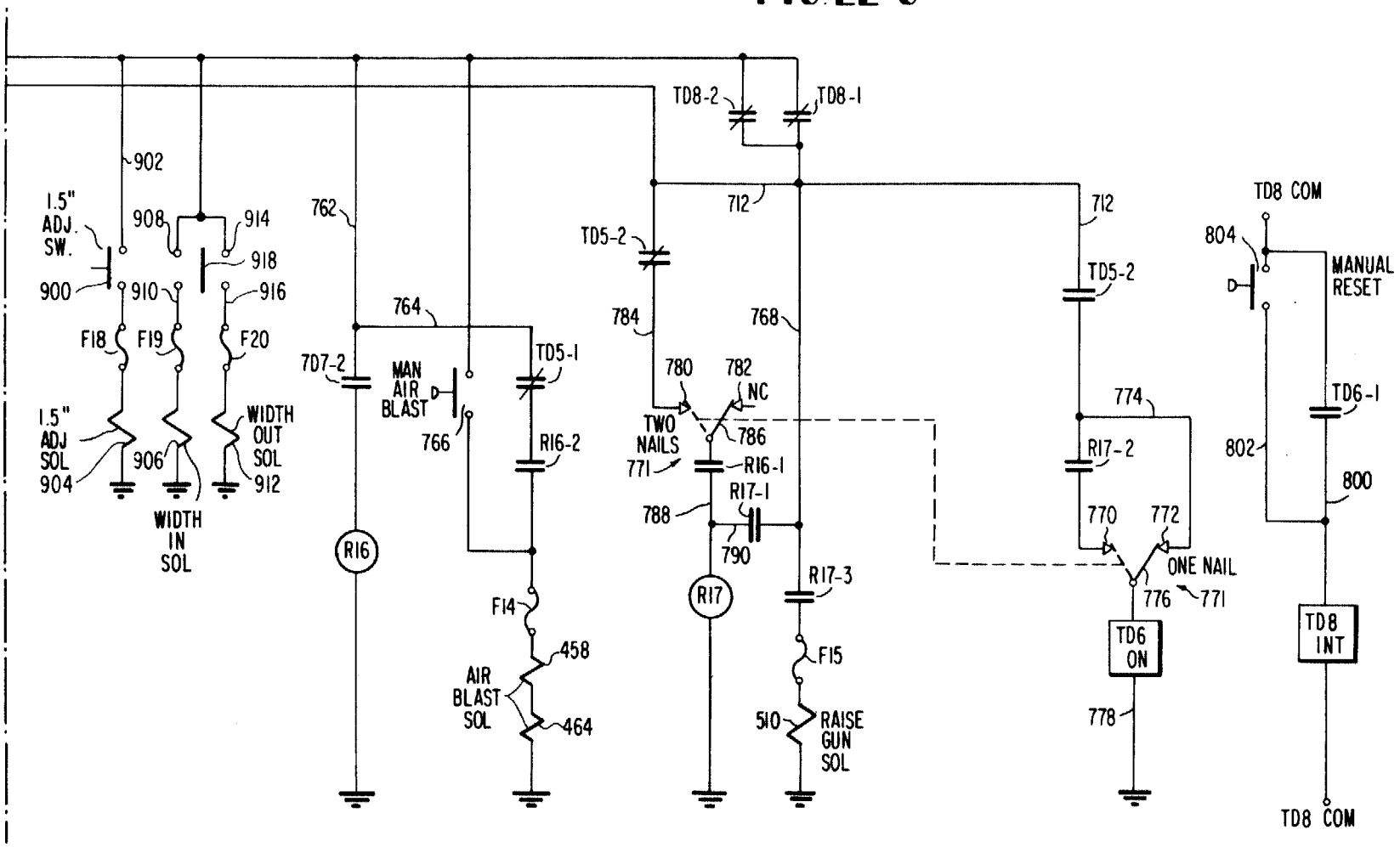

FIGS. 5, 6 and 7 are fragmentary enlarged cross-sectional views thereof generally taken about on lines 5—5, 6—6 and 7—7, respectively, in FIG. 3;

FIG. 8 is a fragmentary enlarged cross-sectional view of the nail head assembly with parts broken out and in cross section for ease of illustration;

FIG. 9 is a cross-sectional view thereof taken generally about on line 9—9 in FIG. 8;

FIG. 10 is a view similar to FIG. 8 and illustrating the nail head assembly in an advanced position fully embedding a nail into the frame;

FIG. 11 is a fragmentary cross-sectional view thereof;

FIG. 12 is a fragmentary cross-sectional view with parts broken out in cross section of a mechanism for adjusting the width of the conveyor and drive unit assembly;

FIG. 13 is a fragmentary side elevational view of a nail feed assembly for the machine hereof;

FIG. 14 is an enlarged cross-sectional view thereof taken about on line 14—14 in FIG. 13;

FIG. 15 is a plan view thereof;

FIG. 16 is a vertical transverse sectional view of the conveyor and nailing assemblies and further illustrating the width adjustment mechanism;

FIG. 17 is a cross-sectional view thereof taken about on line 17—17 in FIG. 16;

FIGS. 18 and 19 are end and side elevational views respectively, of a lumber hold-down mechanism;

FIGS. 20A, 20B and 20C are schematic illustrations of various pneumatic circuits employed with the present invention;

FIG. 21 is a schematic illustration of a hydraulic circuit for use with the fabricating machine hereof; and FIGS. 22A, 22B and 22C taken together constitute a schematic illustration of the electrical circuit for use with the fabricating machine hereof, the FIGS. 22A, 22B and 22C being arranged end to end and from left to right, respectively, to complete the electrical circuit.

Figure 1:
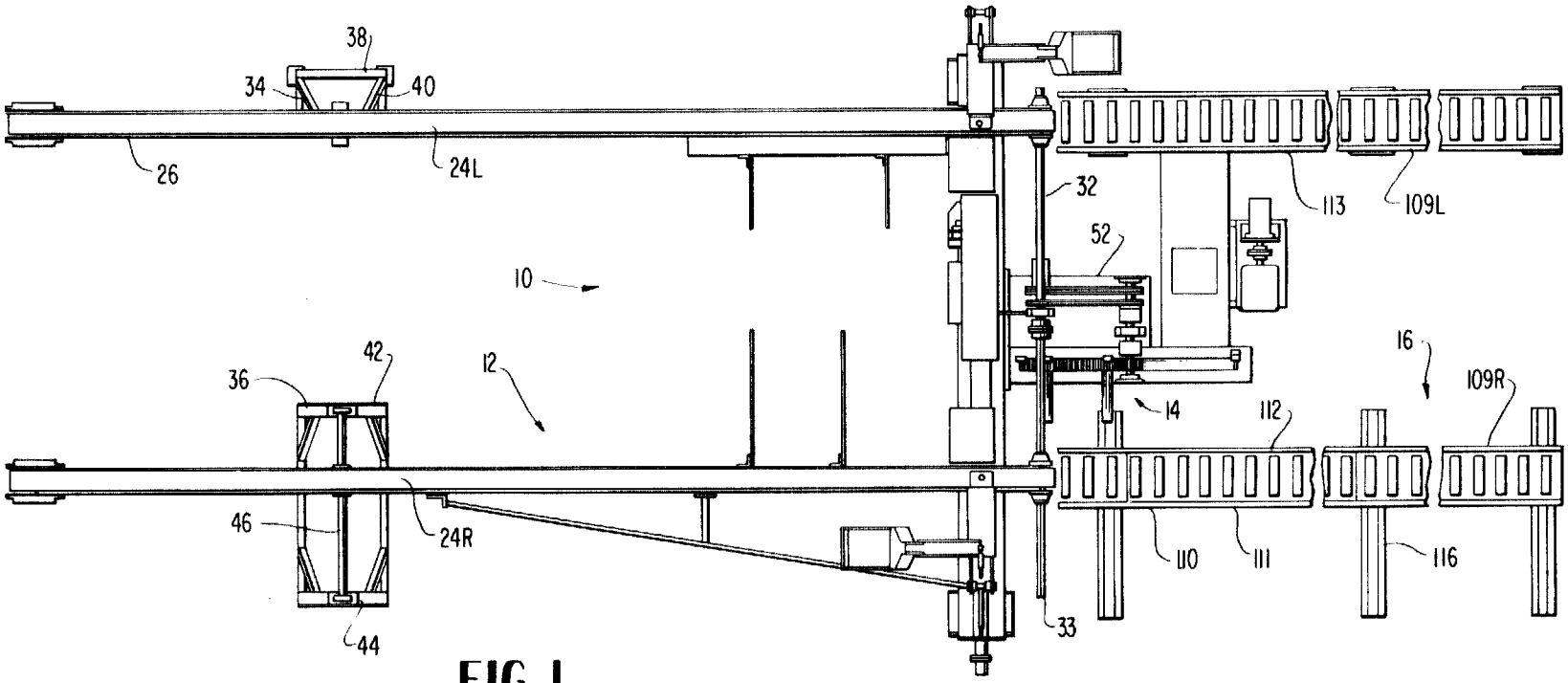
FIG. 1 is a plan view of a fabricating machine constructed in accordance with the present invention and with parts broken out for ease of illustration.
Figure 2:
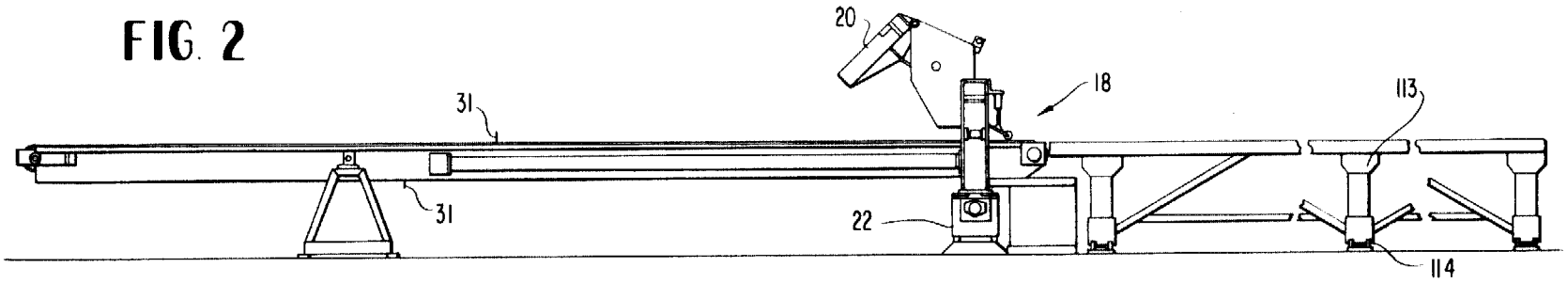
FIG. 2 is a side elevational view thereof.

Referring now to the drawings, particularly to FIGS. 1 and 2, there is illustrated a panel fabricating machine constructed in accordance with the present invention and generally indicated 10. Machine 10 generally includes a conveyor 12, a drive unit 14 for the conveyor, a downstream roller conveyor 16, a nail head assembly 18, a nail feed assembly 20 and a width adjustment assembly 22. Conveyor 12 comprises left- and right-hand laterally spaced conveyor rails 24L and 24R each formed of laterally spaced elongated channels 26 suitably connected one to the other and having an idler sprocket, not shown, at one end and a drive sprocket 28 (FIGS. 3 and 6) at the opposite end. A flat top conveyor chain 29 engages about the idler and drive sprockets and carries tread 30 which, on the upper surface of the conveyor rails 12, rides on a pair of bearing surfaces, not shown. Drive sprockets 28R and 28L are coupled to shafts 32 and 33 respectively, which are driven by the drive unit assembly 14. Portions of the conveyor rails 24L and 24R are supported by conveyor rail floor stands 34 and 35 respectively. Stand 34 includes a base 38 and diagonally upstanding support brackets 40 whereby the attached conveyor rail 24 L is maintained in a fixed position. Stand 36 includes a base 42 and a pair of upstanding end brackets 44 which mount a shaft 46 received through the side cannel members 26 whereby the conveyor rail 24R is slidable along shaft 46 in a lateral direction to obtain selected adjusted positions as set forth hereinafter. The drive sprocket 28 at the forward end of conveyor rail 24R is splined to the square shaft 33 whereby the conveyor rail 24R and drive sprocket carried thereby are free for transverse movement relative to shaft 33. Treads 30 carry a plurality of longitudinally spaced lumber drive members 31 which project above the treads for engagement with the ends of the plates of the panel undergoing fabrication. The treads 30 carry the frame plates through nailing head assemblies 18 whereat the cross members of the frame, i.e., studs, are nailed to the plates. Guides, not shown, are placed along opposite sides of each of the conveyor treads whereby the plates are retained on the conveyor for movement toward the nail head assemblies 18.

The nailing head assemblies 18 are each carried on a machine base 50 to which is secured, on the side thereof remote from the conveyor 12, a support base 52 for the drive unit 14. Base 52 carries a mounting plate 54 carrying an upright 56 to which a hydraulic motor 58 is secured. Forwardly of motor 58 there is mounted a shaft 60 carrying a sprocket 62. Shaft 60 is mounted at one end in a bearing 64 carried by plate 54 and at its other end by an air clutch 66. Motor 58 is drivingly coupled to shaft 60 through a sprocket 68 and chain 70, the chain 70 passing over idler sprocket 72. Air clutch 66 carries a drive sprocket 74 which, via a chain drive including chain 76 and a sprocket 78 carried by shaft 32, drives shaft 32 in opposite directions depending upon the direction of rotation of the output shaft of motor 58. A phasing coupling 80 couples shaft 32 one to the other whereby the right- and left-hand conveyors 24R and 24L respectively operate in synchronism one with the other.

Shaft 60 on the drive unit extends through air clutch 66, through a pillow block 82, and drives a second air clutch 84. Clutch 84 mounts one end of an output shaft 86, the other end of which is carried in a bearing 88 mounted on plate 54. Shaft 86 also mounts a drive pinion 90 which meshes with a rack 92 slidable along a recess 94 defined by upstanding elongated side and end plates 93 and 95 respectively mounted on plate 54. It will thus be appreciated that by actuation of clutch 84, drive pinion 90 rotates in response to rotation of shaft 60 to slide rack 92 along recess 94 in opposite directions depending upon the direction of rotation of motor 58. The rack 92 is illustrated in FIG. 3 in a "zero" position, that is, its forward end bears against the forward wall of recess 94. Spaced along the recess and from the opposite end of rack 92 at increments of 1.5 inches and 16 inches are dogs 96 and 98 carried for sliding movement in transversely extending slides 100 and 102, respectively. Brackets 101 and 103 project outwardly from a side 93 of recess 94 and mount air-actuated cylinders 104 and 106, respectively. The pistons of cylinders 104 and 106 are connected to the respective dogs 96 and 98. It will be appreciated that actuation of either cylinder causes the corresponding dog to be inserted into the recess 94 and into the path of movement of rack 92 preventing further movement thereof. For reasons to be discussed hereinafter, the end of recess 94 carries a stop pad 108 located precisely 24 inches from the near end of rack 92 when the rack is located in its "zero" position. At each of the 1.5, 16 and 24 inch positions along the recess 94, there is also mounted micro-switches 110, 112, and 114 which are engaged by the near end of rack 92 when it obtains the respective longitudinal positions.

Accordingly, it will be appreciated that by actuation of cylinder 104 or cylinder 106, the rack can be stopped after 1.5 or 16 inches of movement, respectively. The rack is, of course, stopped by stop pad 108 after 24 inches of movement. As will become clear from the ensuing description, the dogs 96 and 98 and stop pad 108 are utilized because of the inertia of the system and effectively stop the conveyor instantaneously through conveyor clutch 66 when the rack engages the dogs or stop pad, as the case may be. When stopped by the dogs 96 or 98 or stop pad 108, the corresponding micro-switch is actuated. When the micro-switch is actuated, clutch 66 is disengaged whereby the coupling between the drive motor 58 and the conveyor drive shaft is broken and the motor 58 reverses. Clutch 84, however, remains engaged and, with motor 58 reversed, the pinion 90 drives the rack 92 back to its zero position into engagement with a micro-switch 116 which serves to disengage clutch 84. By the foregoing arrangement, it will be appreciated that conveyor drive shaft 32 can be selectively rotated to advance the plates carried on treads 30 discrete distances of 1.5, 16 and 24 inches upon command. It will also be appreciated that slides 100 and 102 can be located at other selected positions along the recess 94 whereby the conveyor can be advanced other selected discrete distances. Also, spacer blocks can be provided at the end of recess 94 to provide a final discrete movement other than 24 inches. It will also be appreciated that additional slides containing air-actuated cylinders and dogs can be provided, as desired, wherein any desired number of discrete movements can be obtained.

The downstream conveyor 16 comprises a pair of spaced roller conveyors 109L and 109R each including spaced side rails 110 and 112 with longitudinally spaced rollers connected therebetween. Downstream roller conveyor 109L is fixed on suitable supports, not shown, while roller conveyor 109R is mounted for movement in a transverse direction relative to conveyor 109L. Particularly, conveyor 109R is carried by longitudinally spaced uprights 113, the lower ends of which mount rollers 114 for movement along a transversely extending back or base 116. Accordingly, roller conveyor 109R can be selectively transversely spaced from fixed roller conveyor 109L and in accordance with the spacing of conveyor 24R from fixed conveyor 24L whereby conveyors 24R and 109R are maintained in longitudinal registry one with the other.

Referring now to FIGS. 4, 8, 10 and 11, the base 50 of the machine includes a pair of transversely extending channels 130 spaced one from the other and carried on suitable supports 132 (FIG. 16). The upper ends of the channels each mount inwardly projecting plates 134. Each of the nail head assemblies 18L and 18R comprises a pair of generally longitudinally spaced upstanding C-shaped plates 136 between which is mounted a nailing gun generally indicated 13F and ancillary equipment therefor. The plates 136 are carried on a lower mounting plate 138. Each mounting plate 138 extends inwardly toward the opposite nail head assembly to provide support for a housing 142 described hereinafter. Mounting plate 138L is secured to its mounting plates 134, i.e. by welding or the like. The mounting plate 138R for nail assembly 18R carries a gib 140 whereby the nailing head 18R is slidable on mounting plates 134 transversely along base 50.

Each plate 138 also carries a housing 142 for mounting a pair of retractable fingers or stops 144, the purpose of which is described hereinafter. Each housing 142 is connected by a bracket 146 to the C-shaped plates 136. Between the housing 142 and nail head assembly 18 on the respective opposite sides of the machine and above bracket 146, extends the forward end portion of the drive conveyor. The conveyor channels 26 are suitably secured to the nail head assemblies 18 and housings 142. It will be appreciated from the foregoing that the left-hand nailing assembly 18L, housing 142, and conveyor 24L are fixedly mounted relative to base 50. However, the nail head assembly 18R, housing 142R and the conveyor 24R carried between housing 142R and nail assembly 18R are carried for transverse sliding movement relative to base 50.

To adjust the position of the nail head assembly 18R, housing 142R and the conveyor rail 24R relative to the corresponding left-hand parts thereof, there is provided a width adjustment assembly 22 including, as best illustrated in FIG. 12, an elongated screw 150 threadedly carrying a mounting bracket 152 secured to the underside of gib 140. Mounted at one end of screw 50 through a self-aligning rod and coupler 154 is a hydraulic cylinder 156 for shifting the screw thread 150 axially a discrete distance equal to 1.5 inches for reasons noted hereinafter. Cylinder 156 is fixed to base 50 between channels 130. The opposite end of screw thread 150 is splined to a drive coupling 158 carried in a bearing 160 mounted in a motor housing 162. Housing 162 is secured to an end plate 163 in turn secured to channels 130. A hydraulic motor 164 is carried on housing 152 and its shaft 166 is splined to drive coupling 158. Accordingly, it will be appreciated that actuation of motor 164 drives shaft 166 and hence screw thread 150 in rotary direction dependent upon the direction of rotation of motor 164 whereby bracket 152 is displaced axially along thread 150. With the foregoing arrangement, the hydraulic cylinder 156 can be actuated to displace the nail head assembly 18R, housing 142R and the right-hand conveyor 24R a distance of 1.5 inches either inwardly or outwardly depending upon its initial position whereas the hydraulic motor can displace these elements relative to the corresponding elements on the opposite side of the machine selected distances as desired and within a range determined by the length of thread 150. The discrete width adjustment of 1.5 inches permits ready adjustment of the machine for handling exterior and interior wall panels which differ in width one from the other by approximately 1.5 inches.

A telescoping lumber support assembly, generally indicated 170 in FIG. 16, is provided between the left- and right-hand nailing assemblies 18L and 18R, respectively, and specifically between housings 142L and 142R. The support assembly 170 includes a pair of laterally spaced channels 172 suitably secured at one end to housing 142R. One end of another pair of channel-shaped members 174 are suitably secured to housing 142L. The opposite ends of channel members 174 are received within the ends of channel members 172. Suitable lateral braces 176 are provided between the channel members 172 and 174 at spaced locations therealong. A tray 178 is releasably mounted on top of the channel members 172 and 174. Tray 178 includes a flat upper plate 180, elongated bearing surfaces 182 which ride on the upper flanges of the channels 172 and 174, and side retaining flange 184. It will be appreciated that tray 178 can be moved along the channel members 172 and 174 and that when the nail assembly 18R, conveyor 24R and housing 142R are displaced laterally along the base of the machine, the channel members 172 and 174 telescope one within the other.

Within each housing 142, there is provided a pair of laterally spaced risers 186 (FIG. 11). Pivotally connected at the lower end of each riser is an upstanding cylinder 188, the piston rod 190 of which is secured to a stud stop or finger 144. The fingers 144 project through an opening in the upper wall 192 of each housing 142 and are generally square in cross section. The fingers 144 are transversely aligned one with the other whereby they form abutments for the studs S located between the plates P.

Turning now to FIGS. 8 and 10, nail gun 137 includes a carriage 200 having a longitudinally extending central aperture 202 and a nail-receiving aperture 204 (FIG. 10) for receiving nails from a flexible line 206 from the nail hopper. The carriage 200 is formed of discrete upper and lower parts with such parts held together by a spring in housing 208. Carriage 200 is secured to a gib 210 which is slidably mounted along a bar 212, the gib 210 being T-shaped in cross section and being received within a slot at the end of bar 212. Gib 210 has a slot along a lower portion thereof in which is received a pin 214 carried by bar 212. Gib 210 is biased by a compression spring 218 for movement into the position illustrated in FIG. 10, that is, in a position advanced to butt the plate P.

To drive the nails into the plate P, a hydraulic cylinder 220 is carried on bar 212. Cylinder 220 carries a piston 221 which mounts a bracket 222. Bracket 222 carries a nail driving rod 224 which is received within the central aperture 202 of the nail gun 137. It will be appreciated that actuation of cylinder 220 advances nail driving rod 224 such that the end of rod 224 engages a nail within aperture 202 and drives the nail through the forward end of the gun into the plate and stud S. Further, it will be appreciated that full extension of piston 221 carried by cylinder 220 causes bracket 222 to butt the rear end of gun carriage 200 and advance the latter relative to bar 212 whereby carriage 200 bears against the plate P to clamp it to the stud S. Thus the nail is fully seated only when the plate and stud engage one another. Also carried on bracket 222 is a plate 226 (FIGS. 8 and 9). Plate 226 has a lower aperture 228 which receives a pull rod 230. One end of pull rod 230 is secured to gun carriage 200 while the other end carries an enlarged head 232. Plate 226 also carries a downwardly projecting tab 234 which engages a micro-switch 793 in response to full seating of the nail in the plate and stud and complete advance of the gun carriage 200 toward the plate and stud. Thus, to drive a nail into the plate and stud, the cylinder 220 is actuated whereby the compression spring 218 advances the carriage 200 against the plate. Drive rod 224 thereafter advances the nail in aperture 202 into the plate and stud. Full extension of the cylinder 220 butts bracket 222 against the rear end of gun carriage 200 to clamp the forward end of carriage 200 against the plate and stud and ensure final seating of the nail with the plate and stud in butting engagement. Upon full seating of the nail and full advancement of carriage 200, tab 234 engages the micro-switch 793 which causes, as explained hereinafter, the cylinder to retract. Upon retraction of piston 221, the plate 226 engages the head 232 of pull rod 230 prior to full retraction of piston 221. Thus, rod 230 serves to withdraw or pull the gun carriage 200 back from engagement with the plate, i.e., back to the position illustrated in FIG. 8, in response to full retraction of piston 221.

In order to drive two or more nails into the plate and stud depending upon the size of the panel undergoing the fabrication, nail gun 137 is mounted for pivotal movement whereby it can be shifted vertically to align another nail in the gun carriage with selected positions along the width of the wooden plate. To accomplish this, bar 212 which carries gun carriage 200 and ancillary equipment including cylinder 220, is pivotally mounted between the C-frame plates 136 at 240. To maintain the gun at a preselected level or elevation and to shift the gun from one elevation to another, there is provided a hydraulic cylinder 242 pivotally mounted at 244 between plates 136 on a bracket 246. The piston 257 of cylinder 242 is pivotally connected to a clevis 248 secured on the underside of bar 212. Also carried by bar 212 is a pair of upwardly projecting stope 250 which engage a pin 252 located in selected openings along fixed brackets 254. That is, cylinder 242 when actuated raises bar 212 until brackets 250 engage pins 252 limiting upward movement of the entire nailing gun assembly. Openings for the pins 252 are provided at selected elevations along brackets 254. When the cylinder 242 is fully retracted, the centerline of the nailing gun, that is, a line drawn through the axis of the aperture 202 through which the nail emerges for embedment into the plate and stud, inclines downwardly for inserting a nail into the plate about ⅞ inch above the lower edge of the plate. The pins 252 are located in selective openings such that when the gun carriage is elevated and stopped by the pin, the next nail will be embedded at the appropriate elevation above the first nail depending upon the size of the lumber being used. For example, when nailing 2 × 2's, only one nail is utilized and this would be driven into the plate with the gun carriage in its lowermost position with cylinder 242 fully retracted. For a 2 × 4, two nails are used. The first nail is applied at a location ⅞ inch from the lower edge of the plate and the gun carriage is thereafter raised such that the next nail would be located a distance about 2¾ inches from the lower edge of the plate. For a 2 × 6, the pin would be located such that the gun carriage would be elevated to embed the second nail a distance about 4½ inches from the lower edge of the 2 × 6 plate. It is a feature hereof that the axis of the nail driving cylinder 220 is located about ⅛ inches above the tread 30 whereby each nail driven into the various standard sized plates will be driven at an angle. This is advantageous in that the resistance to withdrawal of the nail is increased due to its angled insertion. Also, when two nails are driven, they provide a clinching action is securing the plate and stud one to the other.

Referring now to FIGS. 13, 14 and 15, one of the left and right-hand nail feed assemblies 20 is illustrated. Each assembly comprises a hopper 260 for receiving randomly distributed nails. Hopper 260 is pivoted at its upper end between a pair of main plates 262 by means of brackets 264 and pins 266. Main plates 262 are, of course, secured to the C-frame plates 136 of the nail assembly 18. The hopper has a longitudinally extending slot 268 in which the randomly distributed nails are received with the shank portions of the nails extending through the slots and the nails being held by the heads engaging along the margins of the slot. At the forward end of the hopper 260 there is provided a main gate 270 having a notch 271 along its lower edge for permitting the head of each nail to pass through the notch. Guide tracks 272 are connected to an escapement generally indicated 274. The guide tracks 272 are spaced such that the nails received in the guide tracks are singulated one behind the other with the nails depending from their heads through the slot 26 between the guides.

To distribute the nails from hopper 260 into slot 276, the hopper 260 is continuously oscillated between the illustrated downwardly inclined position and a position wherein the bottom of the hopper forms essentially a continuation of tracks 272. To accomplish this oscillation, there is provided an eccentric including an arm 278 pivoted at one end to the bottom of hopper 260 and at its other end to a crank 280, the crank being rotated by a hydraulic motor 281. It will be appreciated that rotation of crank 280 oscillates hopper 260 between the aforementioned positions whereby the nails are singulated along the tracks 272. The nail escapement 274 for each nail feed assembly 20 is per se conventional and forms no part of the present invention. Further description thereof is therefore believed unnecessary, it being sufficient to note that nails are dropped one at a time from each of the left and right-hand escapements 244 through the associated nail feed line 206 by actuation of the corresponding air cylinder 282L and 282R which, in turn, respectively operates spring biased nail picks 284. That is, each time the pick is displaced by actuation of a cylinder 282 a nail drops into the corresponding nail feed line 206.

Mounted on the inside end of the nailing head assemblies are plate and stud clamps generally indicated 300 (FIGS. 8, 10 and 11). Preferably, a bracket 302 connects between the forward ends of C-frame plates 136. A clamp cylinder bracket 304 is mounted to bracket 302 by bolts 303. Bracket 304 has a pair of vertically elongated slots 305 by which its position relative to bracket 302 can be adjusted as desired. Bracket 304 carries an outwardly projecting plate 306 mounting a hydraulic cylinder 308, the piston of which extends through plate 306 and carries at its lower end a clamp platen 310. Platen 310 carries a guide rod 312 which extends upwardly through an opening in plate 306 whereby the platen is maintained in alignment. The platen face carries a clamp 314 having a serrated or otherwise roughened edge for clamping engagement against the stud S. Clamp 314 is carried in a recess formed in the face of platen 312. The remaining portion of the lower face of platen 312 which bears against the plate P is smooth. Thus, when the cylinder 308 is actuated to engage platen 312 against the plate and stud, the stud is held in fixed position by clamp 314 while the plate is free to move inwardly against the end of the stud along the lower surface of platen 310. That is, the gun carriage 200 can displace the plate P inwardly along the lower face of platen 312 into engagement with the stud end which is held in place by clamp 314.

Carried by housing 142 and adjacent the left and right hand nailing assemblies is a pair of stud sensor micro-switches 720 and 716 respectively. Each switch includes a head 332 which projects above the upper surface of housing 142 and which head is engaged by a stud located in butting engagement against the fingers 144. When the stud is so located, head 322 is depressed to actuate switch 720 or switch 716 as the case may be.

Referring to FIGS. 18 and 19, frame hold-down mechanisms are provided on opposite sides of the conveyor downstream of the nail head assemblies to maintain the partially completed frame on the roller conveyor assembly. Each hold-down mechanism includes a roller 330 pivotally carried on a shaft disposed within sleeve 332. Sleeve 332 is coupled to a sleeve 334 pivotally mounted between brackets 336 to the nail head assemblies whereby the roller is pivotal about the axis of sleeve 334. An air-actuated cylinder 338 is pivotally secured at one end to a bracket 340 secured to the lower side of the nail head assemblies. The piston rod 342 is secured to a lever arm 344 also carried on sleeve 334. Accordingly, retraction of cylinder 338 locates the clamping roller 330 on top of the plate and stud as they emerge from the nailing head assembly.

Referring now to FIGS. 20A, 20B and 20C, there are illustrated various pneumatic circuits for the machine hereof. As used in the illustration of the circuits, the small circles indicate a source of air under pressure. Referring first to FIG. 20B, the stop cylinders 188 are connected in parallel via lines 400 and 402 which communicate with a four-way, two-position, spring-returned, valve 404 actuated by finger solenoid 413. Air pressure communicates from a source with the valve 404 via a line 406. The cylinders 188 are connected with lines 400 and 402 via lines 408 and 410, respectively. A pressure regulator 412 is disposed in line 402. Air is supplied under pressure from the source through valve 404 to maintain the pistons 190 of cylinders 188, i.e., fingers 144 in an extended position.

Referring now to FIG. 20C, the 1.5 inch rack stop cylinder 104 is coupled to the air pressure source via lines 412 and 414 and a four-way, two-position, spring-returned valve 416 under control of solenoid 418. The 16 inch rack stop cylinder 106 is connected with the air pressure source via lines 419 and 422 through a four-way, two-position, spring-returned valve 424 under control of solenoid 420. It will be appreciated that both the 1.5 and 16 inch rack stop cylinders 104 and 106, respectively, are normally maintained in a retracted position. Rack clutch 84 lies in communication with the air pressure source via an air line 426 and a four-way, two-position, spring-returned valve 428 actuated by solenoid 430. Conveyor clutch 66 lies in communication with the air pressure source via an air line 432 and a four-way, two-position, spring-returned valve 434 under control of solenoid 436.

Referring now to FIG. 20A, the left-hand nail drop cylinder 282L lies in communication with an air pressure source via lines 438 and 440 and a four-way, two-position, spring-returned valve 442 under control of a solenoid 446, the piston of the cylinder being normally extended. The right-hand nail drop cylinder 282R likewise lies in communication with an air pressure source via conduits 447 and 448 and a four-way, two-position, spring-returned valve 450 under control of a solenoid 452, the piston being normally extended. The left-hand nail blast lies in communication with the air pressure source via a line 454 and a two-way normally closed spring-return valve 456 operated by solenoid 458. The right-hand nail blast is similarly connected with the air pressure source via a line 460 and a two-way, two-position, spring-return valve 462 operated by solenoid 464.

Referring now to FIG. 21, there is illustrated a hydraulic circuit schematic including a hydraulic pump 450 driven by electric motor 452 for supplying hydraulic fluid from a source 454 via a main fluid line 456. A shut-off valve 458 and a pressure gauge 460 are disposed in line 456. Also, a pressure relief valve 462 lies in communication with line 456 via line 464. The left-hand nailing cylinder 220L receives fluid from pump 450 via a line 466, a four-way, two-position, spring-returned valve 468 in communication with line 466 and operated by solenoid 470, and a pair of fluid lines 472 and 474 in communication with valve 468 and with the opposite ends of cylinder 220L. Similarly, the right-hand nail cylinder 220R receives fluid from motor 450 via a line 476 in communication with main line 456, a four-way, two-position, spring-returned valve 478 in communication with line 476, and a pair of fluid lines 480 and 482 in communication with valve 478 and opposite ends of cylinder 220R. Valve 478 is operated by solenoid 484. It will be appreciated that the valves 468 and 478 are normally positioned such that motor 450 supplies hydraulic fluid to the right and left-hand nail cylinders 220L and 220R respectively and the pistons carried thereby are normally retracted.

Connected to fluid line 476 by line 485, is a normally closed four-way, three-position, spring-returned valve 488 operable by solenoids 490 and 492. A pair of fluid lines 494 and 496 connect valve 488 with the inlet and outlet ports respectively of a reversible hydraulic motor 164. Motor 164, as will be recalled, provides for adjustment of the width of the drive conveyors and nailing head assemblies. It will be appreciated that actuation of solenoid 492 shifts valve 488 to the left as illustrated whereby fluid is provided motor 164 to rotate screwthread 150 in one direction to adjust the width of the drive conveyors and nailing head assemblies. De-energization of valve 492 permits the valve to return to its spring-returned normally closed position. Conversely, energization of valve 490 shifts valve 488 to the right as illustrated whereby pressure fluid is supplied via lines 486 and 496 to motor 164 whereby it is driven in a reverse direction. This rotates screwthread 150 in the reverse direction. Thus selective energization of solenoids 490 and 492 adjusts the width between the conveyors and nailing head assemblies infinitely over a range permitting fabrication of wall panels of various heights including most standard heights.

Fluid line 486 connects with main fluid line 456 and serves to supply fluid to the 1.5 inch width adjustment cylinder, the lift cylinders 242, the clamp cylinders 308, and the motors 281L and 281R for oscillating the nail hoppers. Particularly, the 1.5 width adjustment cylinder 156 communicates with line 486 via a line 488 and a four-way, two-position, spring-returned valve 490 and a fluid line 492. Fluid line 494 connects between the opposite end of cylinder 156 and valve 490. Valve 490 is exhausted via a line 496 in communication with a main exhaust line 498. Valve 490 is under the control of a solenoid 500. It will be appreciated that fluid thus flows from pump 450 through valve 490 via lines 56, 486, and 488 to one side with fluid line 502 exhausting the fluid. The lower ends of lift cylinders 242L and 242R communicate with the pressure fluid in line 486 via lines 504, 506, a four-way, two-position, spring-returned valve 508 operated by solenoid 510 and fluid line 512. The opposite sides of the lift cylinders communicate with valve 508 via fluid lines 514 and 516. A line 518 communicates with valve 508 and exhaust line 498. Thus, it will be appreciated that fluid flows via lines 486, 512, through valve 508 and line 516 into cylinders 242L and 242R whereby the same are normally retracted. Upon energization of solenoid 512, valve 508 is shifted to supply pressure fluid via lines 486, 512, 506 and 504 to cylinders 242L and 242R to extend the pistons 247 thereof and hence raise the nailing gun carriages as previously described. De-energization of solenoid 510 permits valve 508 to return to the illustrated position with pressure fluid supplied to cylinders 242L and 242R via lines 512, 516 and 514 and exhausted therefrom via lines 504, 506 and 518.

Fluid line 520 communicates with line 486 and a four-way, two-position, spring returned valve 522 operated by solenoid 524. Fluid line 526 communicates with valve 522 and a fluid line 528 which communicates with the upper end of clamp cylinders 308L and 308R. A pressure-actuated electrical switch 530 lies in communication with line 526. Fluid line 532 communicates with the lower ends of cylinders 308L and 308R and with valve 522 via line 534. Fluid line 536 communicates between valve 522 and exhaust line 498. Thus, upon energization of solenoid 524 valve 522 shifts to provide pressure fluid to clamp cylinders 308L and 308R via lines 486, 520, 526 and 528 while exhausting fluid from the lower ends of the cylinders via lines 532, 534, 536 and 498 whereby the clamp heads 310 are extended to engage the plates and stud. Upon de-energization of solenoid 524, valve 522 is spring-returned to the illustrated position whereby the clamp heads are returned to their retracted positions. Line 542 serially connects the hopper drive motors 281R and 281L. Thus, these motors are on when the hydraulic circuits are actuated.

Pressure fluid also communicates between line 456 and rack and conveyor motor 58 via a four-way, three-position, spring returned valve 550 and fluid lines 552 and 554. Valve 550 is actuated by energization of either solenoid 642 or solenoid 644. Fluid line 556 communicates with line 558 at a juncture between a two-position, one-way, spring-returned valve 560 and a flow control valve 562. Valve is under the control of the fast conveyor solenoid 688. A fluid line 564 communicates with line 558 beyond valve 562 and via a line 506 to a reservoir. Upon energization of the motor forward solenoid, valve 550 is shifted to provide pressure fluid from line 456 to motor 58 via line 552 to advance the conveyor with the fluid exhausting from motor 58 via lines 554, 556 and 558 through the flow control valve 562 to the reservoir. When the fast conveyor solenoid 688 is energized, valve 560 shifts to exhaust fluid from motor 58 via line 558 whereby motor 58 will speed up. Upon de-energization of solenoids 646 and 688, the valves 550 and 560 return to their illustrated positions. Upon energization of solenoid 642, valve 550 is shifted to provide pressure fluid from line 486 to motor 58 via line 554 with fluid exhausting through lines 552, 556 and 566. This operates motor 58 in the reverse direction to return the rack 92 to its initial position. De-energization of solenoid 642 permits valve 550 to return to its spring-returned position.

Electrical Control Circuit

Referring now to FIGS. 22A, 22B amd 22C which are schematic representations of an electrical control circuit for the machine hereof, the circuit is illustrated in a detached contact mode wherein the various relays represented by circles open and close associated contacts in a manner to be described, and wherein time delay relays represented by squares also open and close associated contacts in a manner to be described, normally open and closed contacts being denoted by pairs of parallel lines and slashed pairs of parallel lines, respectively. The contacts have numeral suffixes corresponding to the numeral suffixes of their actuating relay, the second numeral suffix indicating a particular set of the contacts closed and opened by the particular relay designated by the first numeral suffix. Power is provided across line 600 and a reference potential by a suitable power source, not shown. Connected across the power supply in line 602 are normally closed contacts R9-1 and R7-1, a normally open 1.5 inch command switch 604, relay R1, normally closed contacts R3-2 and R2-2. Line 606 is connected to line 602 between contacts R9-1 and R7-1 and serially connects a 1.5 inch movement complete switch 608, normally open contacts R1-1 and relay R4. Line 610 connects with line 602 between relay R1 and switch 604 and with line 606 between contacts R1-1 and relay R4. Line 612 serially connects fuse F1 and a 1.5 inch stop solenoid 418 between line 610 and the reference potential. Line 614 connects with line 602 between switch 604 and contacts R7-1. A normally open 16 inch command switch 616, a relay R2, and normally closed contacts R1-2 and R3-3 are serially connected in line 618 and between line 614 and the reference potential. Line 620 serially connects a normally open 24 inch command switch 622, relay R3, and normally closed contacts R2-3 and R1-3 between line 614 and the reference potential. Connected to line 606 across the power supply is line 624 which connects in series a normally closed 16 inch movement complete switch 626, normally open contacts R2-1 and a relay R5. Line 628 connects with line 618 between relay R2 and switch 616 and with line 624 between contacts R2-1 and relay R5. Connected in series between line 628 and the reference potential and in line 630 is a fuse F2 and a 16 inch stop solenoid 420. Also connected to line 606 across the power supply is a line 632 which serially connects a normally closed 24 inch movement complete switch 634, normally open contacts R3-1, and relay R6. Line 636 connects with line 620 between relay R3 and switch 622 and with line 632 between relay R6 and R3-1. Relay R7 and a normally closed rack zero switch 638 are connected in series in line 639 between line 606 and the reference potential. Line 640 connects between line 606 and the reference potential and serially connects normally open contacts R7-1, normally closed contacts TD2-1 and TD3-2, normally open contacts TD-4, fuse F3 and a motor reverse solenoid 642. Connected between the reference potential and line 640 between contact TD3-2 and TD-4 is a relay TD4. Normally open contact TD-3, a fuse F4, and a motor forward solenoid 646 are serially connected in line 648 which connects between line 606 and the reference potential. Normally closed contact R11-4 is disposed in line 650 which connects between lines 600 and 652. Connected in parallel between line 652 and line 654 are normally open contacts R4-2, R5-2 and R6-2, line 654 connecting a relay TD1 between such contacts and the reference potential. Line 656 connects lines 658 and 660 in parallel with line 652. Line 658 serially connects normally open contacts TD-1, fuse F5 and rack clutch solenoid 430 while line 660 serially connects normally open contacts TD-2, fuse F6, and conveyor clutch solenoid 436, llines 658 and 660 connecting between line 656 and the reference potential. Line 662 connects one contact of normally open contacts R7-3 with line 650 between contacts R11-4 and the parallel connected contacts R4-2, R5-2 and R5-2 and its other contact with line 658 between contacts TD-1 and fuse F5. Connected in parallel between line 652 and line 664 are normally open contacts R4-3, R5-3, R6-3, and R9-2. Line 666 connects relay TD2 between line 664 and the reference potential while line 668 connects relay TD3 between line 664 and the reference potential. Line 670 connects between line 664 and the reference potential and serially connects fuse F7 and the finger solenoid 413. Line 672 connects relay R9 and a normally open manual positioning switch 674 in series across line 652 and the reference potential. Line 691 connects through line 606 to line 602 between R9-1 and R7-1. Disposed serially in line 691 are the normally closed contacts TD1-2.

Turning back now to FIG. 22A, line 676 serially connects relay R8, a normally closed zero slow switch 680, a normally closed 24 inch slow switch 682 and a normally closed 16 inch slow switch 684. Line 686 connects to line 676 across the power supply and serially connects normally open contacts R8-1, fuse F8 and fast conveyor solenoid 688. Line 690 containing normally open contacts R7-4 connects to line 676 between switches 682 and 684 and to line 604 between contacts R3-2 and R202. Line 692 containing normally open contacts R3-2 also connects to line 675 between switches 682 and 684 and to line 604 between contacts R3-2 and R2-2.

As will be recalled, the foregoing described circuitry relates principally to the manner of advancing the conveyor either automatically in discrete increments of movement or manually. With the circuit energized as illustrated, assume that it is desired to automatically advance the conveyor 16 inches to locate the partially completed frame in position below the nailing heads as more particularly described hereinafter. The operator presses the 16 inch command switch 616 thereby energizing relay R2 via lines 600, 602, 614 and 618 and relay R5 via lines 600, 602, 614, 618, 628 and 624. Energization of relay R2 opens normally closed contacts R2-2 and R2-3 to lock out relays R1 and R1 and energize the 16 inch stop solenoid 420. This prevents actuation of the command circuits through the 1.5 inch and 24 inch command switches 604 and 622, respectively. Energization of relay R2 also closes normally open contacts R2-1 to complete a holding circuit to relay R2 via lines 600, 602, 624 and 628 and to relay R5 via lines 600, 602, 606 and 624. Energization of relay R5 closes normally open contacts R5-2 and R5-3, which respectively energizes time delay relay TD1 via lines 600, 650 and 654 and time delay relays TD2 and TD3 via lines 600, 650, 652, 666 and 668. Closing contacts R5-3 also energizes the lumber finger retract solenoid 413 via lines 650, 652, 664 and 670 whereby the stops or fingers 144 are retracted. Energization of time delay relay TD1 closes normally open contacts TD-1 to energize the rack clutch solenoid 430 via lines 600, 650, 652, 656 and 658. Energization of time delay relay TD2 closes normally open contacts TD-2 to energize the conveyor clutch solenoid 436 via lines 600, 650, 652, 656 and 660 and also opens normally closed contacts TD2-1 to preclude energization of the motor reverse solenoid 642 through line 640. Time delay relay TD3, after a short time delay which allows the rack and conveyor clutches time to be engaged, closes the normally open contacts TD-3 to energize the motor forward solenoid 646 via lines 600, 602, 606 and 648 whereby both the rack and conveyor advance.

When the rack advances, it clears zero slow switch 680 which then closes and energizes relay R8 via lines 600 and 676. Energization of relay R8 closes contacts R8-1 to energize the fast conveyor solenoid 688 via lines 600, 676 and 686 whereupon both the conveyor and rack advance at faster rate. When the rack approaches the 16 inch position, the 16 inch slow switch 684 opens and de-energizes relay R8. De-energization of relay R8 returns contacts R8-1 to their normally open position and de-energizes the fast conveyor solenoid 688 whereupon the rack and conveyor slow as they approach an advance of 16 inches from their zero positions. When the rack obtains the 16 inch position, the 16 inch movement complete switch 626 is opened thereby breaking the holding circuit for and de-energizing relays R5 and R2. De-energization of relay R2 returns contacts R2-2 and R2-3 to their normally closed positions thereby enabling energization of relays R1 and R3 upon command and hence energization of the other discrete movement command circuits and deenergizes the 16 inch stop solenoid 420. De-energization of relay R5 returns contacts R5-2 and R5-3 to their normally open position de-energizing time delay relays TD1, TD2, and TD3 as well as the lumber finger solenoid 413. Deenergization of relay TD3 returns contacts TD-3 to their normally open position de-energizing the motor forward solenoid 646. De-energization of relay TD1 returns contacts TD-1 to their normally open position while de-energization of relay TD2 returns contacts TD-2 to their normally open position de-energizing the conveyor clutch solenoid 436. It will be recalled that when the rack leaves the "zero" position, the rack zero switch 638 closes to energize relay R7. Energization of relay R7 when the rack advances also closes normally open contacts R7-3. Thus, when relays TD1 and TD2 are de-energized in response to movement of the rack and conveyor 16 inches, the rack clutch solenoid 630 is maintained energized via lines 600, 650, 662 and 658 enabling it to be driven in the reverse direction. De-energization of relay TD3 also returns contacts TD3-2 to their normally closed position enabling energization of TD4. When contacts TD2-1 and TD3-2 are returned to their normally closed positions by de-energizatin of relays TD2 and TD3, relay R7 has already closed contacts R7-1. Thus, when contacts TD2-1 and TD3-2 close, relay TD4 is energized via lines 600, 606, 640 and 644 and, in turn, closes normally open contacts TD-4 to energize the motor reverse solenoid 642 via line 640. When the rack moves to the "zero" position, the zero switch 638 opens de-energizing relay R7 which then returns contacts R7-2 to their normally closed position and contacts R7-3 to their normally open position. The latter breaks the circuit to and de-energizes the rack clutch solenoid 430. Opening contacts R7-3 also de-energizes relay TD4 which then returns contacts TD-4 to their normally open position to de-energize motor reverse solenoid 642. It will be appreciated that the circuits for the other discrete commands, that is, the 1.5 command switch and the 24 inch command switch 622 were locked out once the rack left its "zero" position and were only enabled after the rack returned to the "zero" position de-energizing relay R7.

Assuming it is desired to advance the conveyor 1.5 inches, the 1.5 inch command switch 604 is closed thereby energizing relay R1 and the 1.5 inch stop solenoid 418. Energization of relay R1 opens normally closed contacts R1-2 and R1-3 to disable relays R2 and R3 in the 16 and 24 inch command circuits. Energization of relay R1 also closes normally open contact R1-1 to energize relay R4 which in turn closes normally open contacts R4-2 and R4-3. By closing these contacts, relays TD1, TD2, and TD3 as well as the lumber finger retract solenoid 413 are energized as previously described. Energization of relay TD1 closes contacts TD-1 to energize the rack clutch solenoid. Energization of relay TD2 closes contacts TD-2 to energize a conveyor clutch solenoid 436 and also opens contacts TD2-1 to disable relay TD4 and the motor reverse solenoid 642. Energization of relay TD3 closes contacts TD-3 to energize motor forward solenoid 646 whereupon the rack and conveyor advance and also opens contacts TD3-2 to disable relay TD4 and motor reverse solenoid 642. When the rack leaves the "zero" position, rack zero switch 638 closes energizing relay R7 which in turn closes contacts R7-1, R7-4 and R7-3 and opens contacts R7-2 to disable the 16 and 24 inch command circuits. Since the zero slow switch 680 is located beyond 1.5 inches from the rack and therefore is not closed by the rack before the rack moves 1.5 inches, the fast conveyor solenoid 688 remains de-energized, the closing of contacts R7-4 not serving any function at this time. Upon completion of movement of the rack 1.5 inches, the 1.5 inch complete switch 608 opens to de-energize relay R4 and the 1.5 inch stop solenoid 418. De-energization of relay R4 returns contacts R4-2 and R4-3 to their normally open position whereby relays TD1, TD2 and TD3 and the lumber retract finger solenoid 413 are de-energized. The rack clutch solenoid 430, however, remains energized through the closed contact R7-3. De-energization of relays TD2 and TD3 return contacts TD2-1 and TD3-2 to their closed position whereupon relay TD4 is energized after a time delay. Energization of relay TD4 closes contacts TD-4 to energize the motor reverse direction. De-energization of relay TD-2 returns contacts TD-2 to their normally open position to de-energize conveyor clutch solenoid 436 at the same time that the motor reverse solenoid is energized whereby the conveyor remains in its 1.5 inch advanced position. Upon return of the rack to the "zero" position, the rack zero switch 638 opens deenergizing relay R7 thereby returning contacts R7-2 to their closed positions and enabling the discrete command circuits. De-energization of relay R7 also opens contacts R7-1 and R7-3 whereupon the motor reverse solenoid 642 is de-energized and relay TD1 is de-energized to open contacts TD-1 whereby the rack clutch solenoid 430 is de-energized.

With the circuit as illustrated, a discrete movement of 24 inches of the conveyor may also be obtained. To accomplish this, the 24 inch command switch 622 is closed to energize relays R3 and R6. Energization of relay R3 closes normally open contact R3-2 to enable operation of the fast conveyor solenoid 688 as described hereinafter, opens normally open contacts R3-3 to disable relay R2 and hence the 16 inch command circuit, opens contacts R3-4 to disable relay R1 and hence the 1.5 inch command circuit, and closes normally open contacts R3-1 to energize and maintain a holding circuit for relay R6. Energization of relay R6 closes normally open contacts R6-2 and R6-3 thereby energizing relays TD1, TD2, TD3 and the lumber finger retract solenoid 413. Energization of relay TD1 closes contacts TD-1 to energize the rack clutch solenoid 430. Energization of relay TD2 opens contacts TD2-1 to disable the motor reverse solenoid 642 and delay TD4 and closes contacts TD-2 to energize the conveyor clutch solenoid 436. Energization of relay TD3 opens contacts TD3-2 and closes contacts TD-3 to energize the motor forward solenoid 646. When the rack clears its "zero" position, rack zero switch 638 closes to energize relay R7 which in turn opens contacts R7-2 to disable the 16 inch command circuit. Energization of relay R7 also closes contacts R74. When the rack advances past the switch 680, it closes to energize relay R8 which in turn closes contacts R8-1 to energize the fast conveyor solenoid 688. When the rack passes the 16 inch slow switch 684, it opens but the circuit through relay R8 remains energized through line 690 and closed contacts R2-2 thereby to maintain the fast conveyor solenoid 688 energized. When the rack approaches the 24 inch position, the 24 inch slow switch 682 opens to de-energize relay R8 which thereby de-energizes fast conveyor solenoid 688. When the rack reaches the 24 inch position, the 24 inch complete switch 634 opens to break the holding circuit for and de-energize relays R3 and R6. De-energization of relay R3 opens contacts R3-1 to maintain relays R3 and R6 disabled. De-energization of relay R3 also returns contacts R3-4 and R3-3 to their normally closed positions enabling the 1.5 inch and 16 inch command circuit except for contacts R7-2 which are open since relay R7 remains energized. De-energization of relay R6 returns contacts R6-2 and R6-3 to their open positions thereby de-energizing relays TD1, TD2 and TD3 and the lumber finger retract solenoid 413. De-energization of relay TD1 opens contact TD-1 but the rack clutch solenoid 430 remains energized through closed contacts R7-3. De-energization of relay TD2 opens contacts TD-2 to de-energize the conveyor clutch solenoid 436. De-energization of relay TD3 returns contacts TD3 to their open position to de-energize the motor forward solenoid 646. De-energization of relays TD2 and TD3 also return contacts TD2-1 and TD3-2 to their closed positions to energize the motor reverse solenoid 642. When the rack returns to its "zero" position, the rack zero switch 638 opens de-energizing the relay R7 which in turn closes contacts R7-2, opens contacts R7-1 and R7-4 whereupon the motor reverse solenoid 642 is de-energized.

When it is desired to manually position the conveyor, the manual button 674 is closed thereby energizing relay R9 via line 650 and 652. Energization of relay R9 opens contacts R9-1 disabling the discrete command circuits.

It will be noted that whenever the conveyor is advanced discretely, TD1 is energized for a time. Also note that when the conveyor is manually positioned R9 is energized for that time. Therefore, it can be seen that power from line 600 through line 602, R9-1 line 606, line 691, and R2-1 to the nailing circuits is interrupted each time the conveyor is advanced.

Turning now to the nailing circuit illustrated in FIG. 22B, connected across the power supply in line 700 are normally open contacts R11-2 and relay R10. Line 702 connects with line 700 between contacts R11-2 and relay R10 and with line 691, line 702 containing normally open contacts R10-2. Line 704 connects across line 691 and the reference potential and serially connects normally closed contacts R10-1, a normally open nail command switch 706, fuse F9 and clamp solenoid 524. Line 708 connects with line 704 between switch 706 and fuse F9 and contains normally open contacts R11-3. Serially connected in line 710 are a clamp pressure switch 530 and a relay R11. Line 708 and 710 connect in parallel with a line 712 carrying a normally open contact TD5-2. A right-hand lumber sensor switch 716 and a relay R12 are connected in series in line 718. A left-hand lumber sensor switch 720 and relay R13 are connected in series in line 720. Line 718 and 720 are connected in parallel with line 722 which connects with the main line 600. Left and right-hand manual clear switches 724 and 726, respectively, are provided in respective lines 728 and 691. Each switch 724 and 726 has a pair of contact blades, the switches being illustrated in their normal position with all the contacts normally open, with open contacts between lines 728 and 691, lines 736 and 691, and lines 734 and 691, respectively. Time delay relay TD9 lies in line 728. Line 740 serially connects normally open contacts R12-1, fuse F10 and the right-hand nail drive solenoid 484. Line 742 serially connects normally open contacts R13-1, fuse F11, and left-hand nail drive solenoid 470. Line 744 connects lines 740 and 742 in parallel between contacts R12-1 and R13-1 and serially connects normally closed contacts TD7-1 and normally open contacts R11-1 to line 600. Line 736 connects a contact of the right-hand manual clear switch 726 with line 740 between fuse F10 and normally open contacts R12-1. Line 734 connects a contact of left-hand manual clear switch 724 with line 742 between fuse F11 and normally open contacts R13-1. Line 746 connects with line 600 and connects lines 748 and 750 in parallel one with the other and has serially connected normally open TD5-1 contacts in it. Line 748 serially connects normally open contacts R12-2, fuse F12, and right-hand nail solenoid 452. Line 750 serially connects normally open contacts R13-2, fuse F13, and left-hand nail drop solenoid 446. Line 752 connects with line 748 between contact R12-2 and fuse F12 and with a contact of a right-hand nail drop switch 754. Line 756 connects with line 750 between contacts R13-2 and fuse F13 and to a contact of a left-hand nail drop switch 758. Line 760 connects lines 752 and 756 in parallel with line 600 through the open contacts of switches 754 and 758. Line 762 connects in series across the power supply normally open contacts TD7-2 and relay R16. Normally closed contacts TD5-1, normally open contacts R16-2, fuse F14, and the air blast solenoid are connected in series in line 764 connected across the reference potential and line 762 between line 600 and contacts TD7-2. A normally open manual air blast switch 766 is connected between line 600 and line 764 between contacts R16-2 and fuse F14. Normally closed contacts TD8-2 and TD8-1 are connected in parallel between line 600 and line 768. Line 768 also serially connects normally open contacts R17-3, fuse F15, and a raise gun solenoid 510. Line 712 connects with line 768 and contains a normally closed contact TD5-2. One contact 770 of a nail selector switch 771 connects with line 712 through a normally open contact R17-2. Another contact 772 of the nail selector switch 771 connects with line 712 between contacts TD5-4 and R17-2 via line 774. The arm 776 on the selector switch connects with a time delay relay TD6 via line 778 connected to the reference potential. The nail selector switch 771 also includes another pair of contacts 780 and 782. Contact 780 connects with line 712 by line 784, line 784 having normally closed contacts TD5-2. Contact 782 is not connected (open). The arm 786 of the nail selector switch 771 connects in line 788 which serially connects contacts R16-1 and relay R17 with the reference potential. Line 790 has normally open contacts R17-1 and interconnects line 788 between relay R17 and contacts R16-1 and line 768 between contacts R17-3 and contacts TD8-1 and TD8-2. The switch arms 776 and 786 are mechanically interconnected.

Turning now to FIG. 22B, line 792 serially connects between relays TD5, TD7, switch terminals normally closed contacts TD9-1, a normally open right-hand nail driven switch 793, normally open contact R12-3, normally open left-hand driven switch 795, and time delay relay TD5. Line 794 serially contacts normally closed contact R12-3, normally open contact R13-3, normally closed contact R13-3 and time delay relay TD7, line 794 connecting with line 792 between contacts TD9-1 and switch 793. Line 796 connects with line 794 between contacts R12-3 and R13-3 and also connects with line 792 between switch 793 and contacts R12-3. Line 798 connects with line 794 between mechanically interconnected contacts R13-3 and connects with line 792 between contacts R12-3 and switch 795.

Turning now to FIG. 22C, line 800 connects normally open contacts TD6-1 and a time delay relay TD8 in series across a TD8 switch terminal and TD8 common terminal. Line 802 contains a manual reset switch 804, line 802 connecting with the TD8 switch terminal and with line 800 between contacts TD6-1 and relay TD8.

Once the plates and stud are in place for nailing, the nail command switch 706 is closed and energizes clamp solenoid 524 via line 704. When the pressure in the hydraulic circuit builds up to a predetermined limit, a clamp pressure switch 530 closes and energizes relay R11 via lines 710 and 712, through closed contacts TD8-1 and TD8-2, and line 600. Energization of relay R11 closes contacts R11-3 to provide a holding circuit for the clamp solenoid 524 via lines 708, and 600. Energization of relay R11 closes normally open contacts R11-2 to energize relay R10 via line 700 and which relay R10 opens contacts R10-2 and closes contacts R10-2. Closing contacts R10-2 provides a holding circuit for relay R10 via line 691 and 702. Energization of relay R11 also opens normally closed contacts R11-2 thereby disabling the circuits for the rack and conveyor clutch solenoids 430 and 436, respectively, and preventing movement of the rack and conveyor during nailing.

The right and left-hand lumber switches 716 and 720 close when the plates lie in position below the clamp heads ready for nailing. Closing switches 716 and 720 energizes relays R12 and R13 which respectively close normally open contacts R12-1 and R13-1 thereby enabling the nail drive solenoid circuits. It will be recalled that contacts R11-1 closed upon energization of relay R11 and then only when full clamping pressure was developed. Consequently, upon closing contacts R11-1, right and left-hand nail drive solenoids 484 and 470 are energized via lines 744, 740 and 742. When the nails are fully driven and the gun carriage is fully extended against the plates, the right and left-hand driven switches 793 and 795 close and through contacts R12-3 and R13-3 energize relays TD5 and TD7. Energization of relay TD5 closes contacts TD5-1 and through contacts R12-2 and R13-2 previously closed by energization of relays R12 and R13, energize the right and left-hand nail drop solenoids 452 and 446, respectively. Energization of relay TD5 also opens contacts TD5-1 momentarily disabling the air blast solenoids and closes contacts TD5-2 to enable energization of time delay relay TD6 depending upon the position of nail selector switch 776 and whether the first or second nail is being embedded if the switch is in the two-nail position. Energization of relay TD7 opens closed contacts TD7-1 to de-energize the right and left-hand nail drive solenoids 484 and 470, respectively whereby the nail cylinders retract the gun carriages. Energization of relay TD7 also closes contacts TD7-2 to energize relay R16 via line 762. Relay R16 closes contacts R16-2 and contacts R16-1. Relay TD5 times out faster than relay TD7. Thus, when relay TD5 de-energizes, contacts TD5-1 close to energize the air blast solenoids through closed contacts R16-2.

It will be recalled that relays TD5 and TD7 are both energized upon completion of nailing. When the nail selector switch 776 has arms 776 and 786 in the one-nail position, energization of relay TD5 after nailing is completed also closes contact TD5-2 to energize time delay relay TD6 via lines 600, 712, 774, and 778, switch arm 776 and closed contacts TD8-1 and TD8-2. Energization of relay TD6 closes contacts TD6-1 to energize time delay relay TD8. Energization of relay TD8 opens contacts TD8-2 and TD8-1 de-energizing the holding circuit for clamp solenoid 524 and relay R11. De-energization of relay R11 returns contacts R11-1 and R11-3 to their normally open positions to respectively disable the nail drive solenoid circuits, and to disable the clamp solenoid 524. De-energization of relay R11 also returns contacts R11-2 to their normally closed position thereby enabling rack and conveyor clutch and finger solenoids 430, 436, and 413, respectively, and ending the one nail sequence.

When the nail selector switch 776 lies in the two-nail position, that is, when arm 786 engages contact 780 and arm 776 engages contact 770, and after nailing and positioning new nails for nailing, relay TD5 times out to return contacts TD5-2 to their normally closed position in line 784 before relay TD7 times out. However, relay R16 is maintained energized through contacts TD7-2 and thereby contacts R16-1 remain closed. Thus, after the nails have dropped and have been air blasted into nailing position in the nailing gun, relay R17 is energized via lines 784, 788 and closed contacts R11-1, TD5-2 and R16-1. Energization of relay R17 closes normally open contacts R17-1 and R17-3 to respectively provide a holding circuit for relay R17 via lines 600, 768 and 790 and energizes the raised gun solenoid 510 to shift the nailing gun to a raised position for driving the second nail. While energization of relay R17 also closes contacts R17-2, energization of relay TD6 is prevented since relay TD5 has previously timed out to return contacts TD5-2 to their open position. When relay TD7 times out, contacts TD7-2 return to their normally open position de-energizing relay R16 and thereby opening contacts R16-2 and R16-1. Air blast solenoids 458 and 464 are thus de-energized while closed contacts R17-1 hold relay R17 energized and hence the raised gun solenoid 510 energized. When relay TD7 times out, contacts TD7-1 are also returned to their normally closed position thereby energizing the right and left-hand nail drive solenoids 484 and 470, respectively, via lines 744, 740 and 742 to drive the second pair of nails. When the second nails are fully embedded, the right and left-hand nail driven switches close to again energize relays TD5 and TD7. Energization of relay TD5 closes contacts TD5-1 to energize the right and left-hand nail drop solenoids 452 and 456, respectively and opens normally closed contacts TD5-2 and TD5-1 to respectively remove the signal to relay R17 via line 784 (relay R17 remains energized through its holding circuit via lines 768 and 790) and interrupt line 764 whereby actuation of the air blast solenoids is delayed.

When relay TD5 was energized after completion of the second nailing, it also closed contacts TD5-2 to energize relay TD6 via lines 600, 712, and 778, and closed contacts TD8-2, TD8-1, TD5-2 and R17-2. Energization of relay TD6 closes contacts TD6-1 to energize time delay relay TD8 via line 800 whereby contacts TD8-1, TD8-2 are momentarily opened. Opening contacts TD8-2 and TD8-3 de-energizes the holding circuit for clamp solenoid 524 and relay R11. De-energization of relay R11 returns contacts R11-1, R11-2 and R11-3 to their normal positions to disable the nail drive circuits and clamp solenoid and enables rack and conveyor clutch and finger solenoids 430, 436 and 413, thereby ending the two nail sequence.

Since either a one or two nail sequence was seen to energize relay R10, which has its holding contact R10-2 returned to power line 600 by line 691 through normally closed contacts TD1-2 and lines 606 and 602 and normally closed contacts R9-1, and since relay R10 also holds open the nail command line 704 with hold open contacts R10-1, it can be seen that relay R10 must be de-energized before the next nail command can be initiated. It will be remembered that relay TD-1 was energized for a time on any discrete movement and that contacts R9-1 are open for a time for any manual movement. Therefore, it can be seen that after any nailing sequence, the conveyor must be moved, and hence the frame repositioned, befor another nailing sequence can be initiated.

It can also be seen that as long as manual movement of conveyor holds R9-1 open, or discrete movement holds TD1-2 open, no nail command is possible since nail command power is from line 690, line 602, R9-1, line 606, line 691 and TD1-2.

In FIG. 22C, a 1.5 inch adjustment switch 900 for adjusting the width of the conveyor and nailing assemblies from the opposing conveyor and nailing assemblies is disposed in line 902 in series with a fuse F18 and a 1.5 inch adjustment solenoid 904. Line 902 connects with line 600. Also, a width in solenoid 906 is connected in series with a fuse F19 and across a pair of normally open contacts 908 in a line 190. A width out solenoid 912 is connected in series with a fuse F20 and a pair of normally open contacts 914 in line 916. Lines 910 and 916 are connected to main line 600. A width adjustment switch 918 is provided to selectively close the contacts 908 or 914 in lines 910 and 916, respectively, whereby the width in and width out solenoids 906 and 912, respectively, may be energized on command.

In operation, the fabricator usually stands between the conveyors 24L and 24R adjacent table 170 between nailing assemblies 18R and 18L. With the electrical circuits energized and the pneumatic and hydraulic circuits in operation, the fabricator depresses the manual air blast switch 766 to energize air blast solenoids 458 and 464 to clear the nail lines. Also, the fabricator usually clears the left and right-hand nailing guns by depressing the left and right-hand manual clear switches 724 and 726, respectively, whereby the left and right-hand nail drive solenoids 470 and 484 are energized to shift valves 468 and 478 to supply hydraulic fluid to nailing cylinders 220L and 220R and extend the nail drive rods. Thereafter, the fabricator closes the right and left-hand nail drop switches to energize the right and left drop solenoids 452 and 446 to retract the nail drop rods and dispose a nail in each of the lines 206. The manual air blast switch is then again closed to locate nails in the nailing guns. It will be appreciated that the hopper drive motors 281L and 281R are energized when the hydraulic circuit is energized to oscillate the hopper whereby nails are provided continuously to the hopper escapements.

The fabricator then manually loads a pair of plates on the conveyors and manually advances the conveyors by depressing manual positioning switch 674 to energize the motor forward solenoid 646 and the conveyor clutch solenoid 436 as well as the finger solenoid 413 in the manner previously set forth. The conveyors are advanced until the lumber pushers 31 engage the rear ends of the plates. The conveyors can then be jogged forwardly manually whereby the forward ends of the plates are laterally aligned with the nailing guns. The fabricator then adjusts the width of the conveyors by utilizing the discrete width control, i.e., he closes the 1.5 inch adjustment switch to energize solenoid 500 to provide hydraulic fluid to cylinder 156 to displace screwthread 150 1.5 inches and hence effect a 1.5 inch adjustment in the distance between both the opposed conveyors and opposed nailing assemblies. Alternately, switch 495 may be closed to energize the appropriate solenoid 490 or 492 whereby valve 488 shifts drive motor 164 in a direction displacing the conveyor and nailing assembly on one side either inwardly or outwardly as desired. Once the nailing and conveyor assemblies are located in the desired lateral position relative to one another, a stud, preferably removed from an overhead conveyor adjacent the nailing assemblies, is located between the plate and against the normally extended stops 190. Thus, the pair of plates and first stud are in position for nailing.

The fabricator then presses the nail command switch 706. Upon closing the nail command switch, clamp solenoid 524 is first energized and thereafter the right and left-hand nail drive solenoids 484 and 470 are energized. As will be recalled, energization of clamp solenoid 524 shifts valve 522 whereby hydraulic fluid is provided clamp cylinders 308L and 308R and extends the clamping heads against the plates and the corresponding end of the stud. Subsequent energization of solenoids 470 and 484, shifts valves 468 and 478, respectively, to provide hydraulic fluid to the left and right-hand nail driving cylinders 220L and 220R, respectively, whereby a nail is driven dthrough each plate and onto the stud end. It will be recalled that extension of the pistons of nail driving cylinders 220L and 220R also clamps the plates against the stud ends prior to final securement. Upon full embedment of the nail, the left and right-hand nail driven switches 795 and 793, respectively, close as previously noted to de-energize nail drive solenoids 470 and 484 and also to energize the right and left-hand nail drop solenoids 452 and 446. De-energization of solenoids 470 and 484 permits valves 468 and 478 to be spring-returned whereby the nail driving cylinders are retracted. Energization of the nail drop solenoids 452 and 446 shifts valves 550 and 440, respectively, to actuate the nail drop cylinders permitting another nail to drop from each escapement into the associated nailing gun. The air blast solenoids 458 and 464 are thereafter energized as previously described and locate the dropped nails in proper position in the nailing guns.

It will be recalled that with the nail selector switch 776 in the one nail position, the holding circuit for the clamp solenoid 524 is de-energized whereby valve 522 is spring-returned and the platens carried by clamp cylinders 208L and 308R are retracted. If the nail selector switch 776 lies in the two nail position, the raised gun solenoid 510 is energized after the second pair of nails has dropped into the nailing guns. Energization of raised gun solenoid 510 shifts valves 508 to provide hydraulic fluid to cylinders 242L and 242R and thereby elevate the nailing guns against the stops 252. The nailing guns are thus located in an elevated position to drive a second nail through the plate and into the stud located therebetween. The right and left-hand nail drive solenoids 484 and 470 are again energized in a manner previously set forth to embed a second nail into each of the opposite sides of the frame undergoing fabrication. When the second nails are embedded, the left and right-hand nail driven switches 793 and 795 close to energize the right and left-hand nail drop solenoids 452, 456 and thereafter the air blast solenoids are actuated whereby another set of nails are dropped into the nailing guns. After the second nailing is complete, clamp solenoid 524 is de-energized to return the platens to a position spaced above the partially completed frame. After completion of the nailing, the conveyor must be advanced before a nailing sequence can be initiated.

Depending upon the nature of the frame undergoing fabrication, the conveyor is advanced a discrete distance by actuation of any one of the 1.5 inch, 16 inch or 24 inch command switches 604, 616 or 622, respectively. For example, if the frame is a standard frame having studs on 16 inch centers, the 16 inch command switch 616 is depressed, to energize the lumber finger retract solenoid 413 as previously described and also to energize the 16 inch stop solenoid 420. Energization of solenoid 413 shifts valve 404 as illustrated in FIG. 20B to provide air to the stop cylinders 188 and hence retract the stop fingers 190 from out of the path of movement of the frame. Energization of solenoid 420 shifts valve 424 (FIG. 20C) to provide air to 16 inch rack stop cylinder 106 to project slide 102 into the path of movement of rack 92. The rack clutch solenoid 430 and conveyor clutch solenoid 436 are also energized in the manner previously described, and, as illustrated in FIG. 20C, shift valves 428 and 434, respectively, to provide air to the air actuated clutches and thereby engage the clutches. Thereafter, the motor forward solenoid 646 is energized to shift valve 550 to provide hydraulic fluid to motor 58. Motor 58 thus drives 32 and 33 and hence advances conveyors 24L and 24R and rack 92. When rack 92 clears the zero slow switch 680, fast conveyor solenoid 688 is energized to shift valve 560 whereby less resistance to the flow of hydraulic fluid from motor 48 to the reservoir is provided permitting motor 58 to run at a faster speed. This, as previously noted, advances both the conveyor and rack at a faster rate. When both the rack 92 and conveyors 24L and 24R have advanced about 16 inches, the 16 inch slow switch 486 opens to de-energize the fast conveyor solenoid 688 and return it to the position illustrated in FIG. 21 whereby motor 58 and consequently the rack and conveyor run at a slower speed. When the conveyor and rack have obtained 16 inches of movement and the rack butts slide 102 and stops, the 16 inch movement complete switch is opened to de-energize motor forward solenoid 646 and return valve 550 to the position illustrated in FIG. 21. Conveyor clutch solenoid 436 is also de-energized enabling valve 434 to return to the position illustrated in FIG. 20C whereby the motor 58 is decoupled from the drive shafts. The lumber finger solenoid 413 is also de-energized upon completion of 16 inches of movement to enable valve 404 to spring-return to its illustrated position whereby lumber stops 190 are extended. Completion of the 16 inch movement of the conveyor and rack also causes the motor reverse solenoid 642 to be energized thereby shifting valve 550 in the opposite direction to run motor 58 in the opposite direction. With the rack clutch engaged, it will be appreciated that motor 58 will thus return the rack to its initial position whereupon the zero switch 638 opens to de-energize the rack clutch solenoid 430 and enabling valve 550 to spring-return to the position illustrated in FIG. 21.

The fabricator is then able to locate another stud between the plates against the extended lumber stops 190 and to initiate the nailing action as previously set forth. The conveyor as previously described can, of course, be moved in increments of 1.5 inches and 24 inches as well as the 16 inches described in detail above. The fabricator need only select the discrete movement desired and initiate such movement by pressing the appropriate one of the discrete movement command switches 608, 622 or 626. It will be recalled from the discription of the electrical circuit that nailing operations cannot be initiated when the conveyor is moving and conversely the conveyor cannot be moved while a nailing sequence is being performed.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A method of fabricating a wooden panel having a pair of elongated plates and intermediate studs comprising the steps of:

disposing a stud between a pair of plates in substantially horizontal coplanar relation with the plates and stud ends lying on support surfaces between a pair of pivotally mounted nailing assemblies having one end thereof disposed at fixed elevations and other ends thereof disposed at one elevation, clamping the plates and corresponding ends of the studs against the support surface to ensure coplanar relation of the studs and plates, displacing said one end of said nailing assemblies toward said plates to engage the plates and clamp the plates against the stud ends in response to actuation of the nailing assemblies, actuating the nailing assemblies to drive a nail through each plate and into the corresponding end of the stud to secure the plates and the stud one to the other, automatically shifting the elevation of said other ends of said nailing assemblies from said one elevation to another elevation in response to completion of nailing at said one elevation, actuating the nailing assemblies when in said other elevation to drive a second nail through each plate and into the corresponding end of the stud at a like longitudinal location as the first nail thereby forming a partially completed frame, advancing the partially completed frame on an endless conveyor a predetermined distance such that said plates are laterally aligned between the nailing assemblies at the location therealong of a second stud, disposing a second stud between said plates said predetermined distance from said first stud, clamping the plates and corresponding ends of the studs against the support surface to ensure coplanar relation of the studs and plates, displacing said one end of said nailing assemblies toward said plates to engage the plates and clamp the plates against the stud ends in response to actuation of the nailing assemblies, actuating the nailing assemblies to drive a nail through each plate and into the corresponding end of said second stud to secure the plates and said second stud one to the other, automatically shifting the elevation of said other ends of said nailing assemblies from said one elevation to another elevation in response to completion of nailing at said one elevation, actuating the nailing assemblies when in said other elevation to drive a second nail through each plate and into the corresponding end of the second stud at a like longitudinal location as the first nail driven into the second stud.

2. A method according to claim 1 including the steps of disposing a stop between said plates and the nailing assemblies, locating the second stud against said stop thereby to locate the second stud a predetermined distance from the first stud and in lateral alignment with the nailing assemblies, displacing said stop out of the path of advance of the partially completed frame in response to completion of nailing of the second stud and plates, advancing the partially completed frame a predetermined distance such that the plates are laterally aligned between the nailing assemblies at the location therealong of a third stud in the frame, disposing the stop between the plates and the nailing assemblies thereby to locate the third stud in a predetermined distance from the first and second studs and in lateral alignment with the nailing assemblies, actuating the nailing assemblies to drive a nail through each plate and into the corresponding end of the third stud to secure the plates and third stud one to the other, automatically shifting the elevation of said nailing assemblies from one elevation to another elevation in response to completion of nailing of the third stud at said one elevation, actuating the nailing assemblies when in said other elevation to drive a second nail through each plate and into the corresponding end of the third stud at a like longitudinal location as the first nail driven into the third stud.

3. A method according to claim 1 wherein the partially completed frame is advanced by a conveyor, and disabling said conveyor in response to actuation of said nailing assemblies, and disabling the nailing assemblies from actuation in response to actuation of the conveyor to advance the partially completed frame, and maintaining said nailing assemblies in disabled condition during advancement of the partially completed frame.

4. A method according to claim 1 including adjusting the elevation of said one ends of said nailing assemblies in the first and second mentioned elevations thereof to drive the nails at different vertically spaced positions relative to one another.

5. A method according to claim 1 including adjusting the spacing between the nailing assemblies one from the other in accordance with the width of the frame undergoing fabrication.

* * * * *

UNITED STATES PATENT AND TRADEMARK OFFICE

CERTIFICATE OF CORRECTION

PATENT NO. : 4,031,604

DATED : June 28, 1977

INVENTOR(S) : John Calvin Jureit et al

It is certified that error appears in the above-identified patent and that said Letters Patent are hereby corrected as shown below:

Column 4, line 5, "cannel" should read --channel--.

Column 5, line 64, "13F" should read --137--.

Column 8, line 25, "stope" should read --stops--.

Column 8, line 59, "is" should read --in--.

Column 9, line 12, "26" should read --276--.

Column 9, line 31, "244" should read --274--.

Column 11, line 61, "56" should read --456--.

Column 12, line 43, after "Valve" insert --560--.

Column 14, line 30, "R202" should read --R2-2--.

Column 23, line 13, "208L" should read --308L--.

Column 24, line 36, "discription" should read --description--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*